US008317218B2

(12) United States Patent
Furr et al.

(10) Patent No.: US 8,317,218 B2
(45) **Date of Patent: *Nov. 27, 2012**

(54) MULTI-FUNCTION BINDING SYSTEM

(75) Inventors: Douglas K. Furr, Orem, UT (US); Brady S. Fox, Orem, UT (US); Matthew E. Miller, Provo, UT (US)

(73) Assignee: Miller Sports International, LLC, Provo, UT (US)

( * ) Notice: Subject to any disclaimer, the term of this patent is extended or adjusted under 35 U.S.C. 154(b) by 98 days.

This patent is subject to a terminal disclaimer.

(21) Appl. No.: 11/900,652

(22) Filed: Sep. 11, 2007

(65) Prior Publication Data

US 2008/0122201 A1 May 29, 2008

Related U.S. Application Data

(63) Continuation of application No. 11/154,288, filed on Jun. 15, 2005, now Pat. No. 7,267,357, and a continuation of application No. 10/467,941, filed as application No. PCT/US02/05174 on Feb. 15, 2002, now Pat. No. 7,178,821.

(60) Provisional application No. 60/579,526, filed on Jun. 15, 2004, provisional application No. 60/348,274, filed on Jan. 15, 2002, provisional application No. 60/268,541, filed on Feb. 15, 2001, provisional application No. 60/268,542, filed on Feb. 15, 2001.

(51) Int. Cl.
*A63C 9/08* (2006.01)

(52) U.S. Cl. ..... 280/618; 280/14.24

(58) Field of Classification Search ..... 280/611, 280/613, 616, 617, 618, 14.21, 14.22, 14.24, 280/623, 625, 11.3, 11.31, 11.33
See application file for complete search history.

(56) References Cited

U.S. PATENT DOCUMENTS 3,061,325 A 10/1962 Glass
3,944,237 A 3/1976 Teague, Jr.
(Continued)

FOREIGN PATENT DOCUMENTS

CH 678 397 9/1991
(Continued)

OTHER PUBLICATIONS

Miller et al., U.S. Appl. No. 11/900,653, filed Sep. 11, 2007.
(Continued)

*Primary Examiner* — Katy M Ebner
(74) *Attorney, Agent, or Firm* — Thorpe North & Western LLP

(57) ABSTRACT

A multi-function binding system configured for use on a sliding board comprising: (a) a binding operable with a boot assembly, the binding comprising a support surface and toe and heel pieces extending therefrom; (b) a base assembly configured to be rotatably and removably secured to a deck of a sliding board and to releasably couple the binding during use of the sliding board, the base assembly comprising: (i) a support disc configured to be removably coupled to the deck of the sliding board and to secure the base assembly to the sliding board; (ii) a deck plate rotatable about the support disc and configured to be positioned adjacent the deck; (iii) a bonnet also rotatable about the support disc and configured to receive and engage the binding, the bonnet operable with the deck plate to support one or more components of the base assembly; (iv) adjustment means for facilitating the rotational adjustment of the bonnet and the deck plate about the support disc and with respect to the sliding board, thereby facilitating a plurality of stance orientations of the boot assembly with respect to the sliding board, the adjustment means configured to selectively engage the support disc at any one of a plurality of adjustment positions; (v) coupling means configured to releasably couple the binding to the base assembly, and therefore the boot system to the sliding board, thereby securing a user thereto; and (vi) release means for actuating the coupling means to release the binding from the base assembly, and therefore the boot system from the sliding board.

24 Claims, 12 Drawing Sheets

U.S. PATENT DOCUMENTS

| | | | | | |
|---|---|---|---|---|---|
| 4,163,569 | A | | 8/1979 | Horn | |
| 4,290,213 | A | | 9/1981 | Salomon | |
| 4,505,493 | A | | 3/1985 | Gustavsson | |
| 4,715,132 | A | * | 12/1987 | Pozzobon | 280/613 |
| 4,728,116 | A | | 3/1988 | Hill | |
| 4,923,207 | A | | 5/1990 | Pozzobon | |
| 5,044,654 | A | * | 9/1991 | Meyer | 280/613 |
| 5,499,837 | A | | 3/1996 | Hale et al. | |
| 5,820,155 | A | * | 10/1998 | Brisco | 280/607 |
| 5,915,721 | A | | 6/1999 | Laughlin et al. | |
| 5,947,508 | A | | 9/1999 | Graf et al. | |
| 5,967,542 | A | * | 10/1999 | Williams et al. | 280/618 |
| 5,971,419 | A | | 10/1999 | Knapschafer | |
| 5,971,422 | A | | 10/1999 | Anderson et al. | |
| 5,984,324 | A | | 11/1999 | Wariakois | |
| 6,062,584 | A | | 5/2000 | Sabol | |
| 6,102,430 | A | | 8/2000 | Reynolds | |
| 6,168,173 | B1 | | 1/2001 | Reuss et al. | |
| 6,182,999 | B1 | | 2/2001 | Bourdeau | |
| 6,213,493 | B1 | | 4/2001 | Korman | |
| 6,257,613 | B1 | | 7/2001 | Porte | |
| 6,279,924 | B1 | | 8/2001 | Murphy et al. | |
| 6,308,980 | B1 | | 10/2001 | Karol | |
| 6,338,497 | B1 | | 1/2002 | Chevalier et al. | |
| 6,416,075 | B1 | | 7/2002 | Laughlin et al. | |
| 6,428,032 | B1 | | 8/2002 | Humbel | |
| 6,457,736 | B1 | | 10/2002 | Maravetz et al. | |
| 6,460,865 | B2 | | 10/2002 | Kellere et al. | |
| 6,523,851 | B1 | | 2/2003 | Maravetz | |
| 6,773,024 | B2 | | 8/2004 | Walkhoff | |
| 6,916,036 | B1 | | 7/2005 | Egli | |
| 7,178,821 | B2 | | 2/2007 | Miller et al. | |
| 7,267,357 | B2 | | 9/2007 | Miller et al. | |
| 2002/0163162 | A1 | | 11/2002 | Haupt | |
| 2005/0285373 | A1 | | 12/2005 | Miller | |
| 2007/0187911 | A1 | | 8/2007 | Morley | |

FOREIGN PATENT DOCUMENTS

| | | |
|---|---|---|
| DE | 8627762 | 11/1986 |
| FR | 2 641 703 | 7/1990 |
| FR | 2 651 143 | 3/1991 |
| WO | WO95/09035 | 4/1995 |
| WO | WO99/13952 | 3/1999 |
| WO | WO99/16515 | 4/1999 |

OTHER PUBLICATIONS

U.S. Appl. No. 11/900,653, filed Sep. 11, 2007; Douglas K. Furr; office action issued Sep. 16, 2010.

U.S. Appl. No. 11/900,653, filed Sep. 11, 2007; Douglas K. Furr; office action issue d Jan. 4, 2012.

* cited by examiner

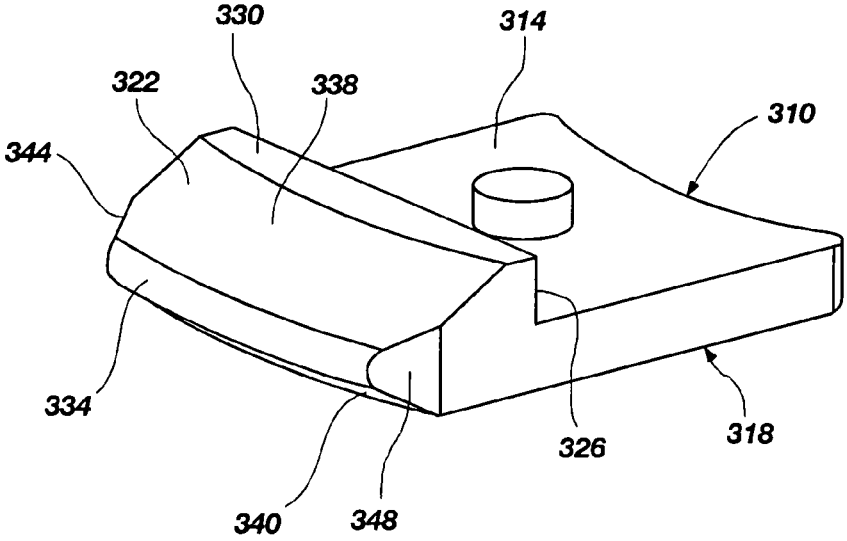
Fig. 9-A
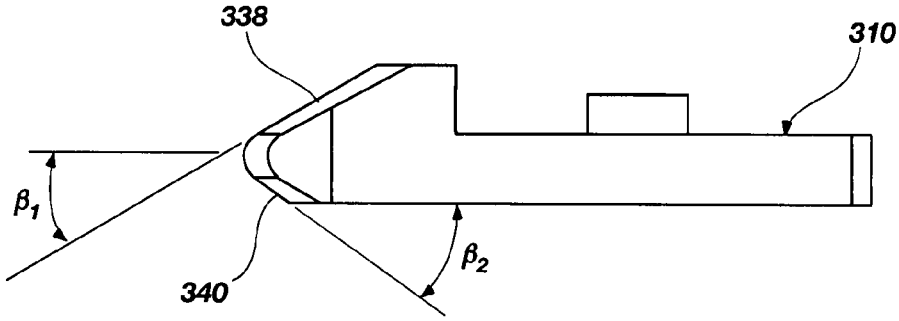
Fig. 9-B
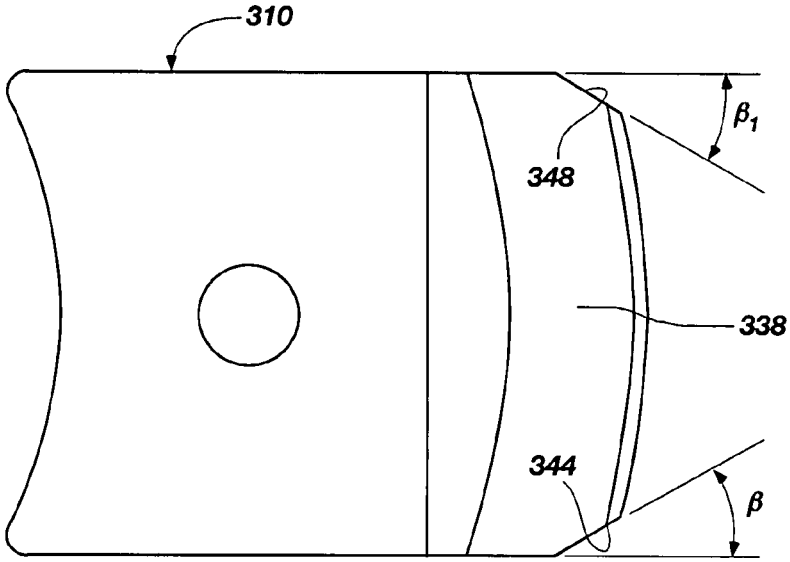
Fig. 9-C

MULTI-FUNCTION BINDING SYSTEM

RELATED APPLICATIONS

This application is a continuation application that claims the benefit of U.S. application Ser. No. 11/154,288, filed Jun. 15, 2005 now U.S. Pat. No. 7,267,357, and entitled, "Multi-Function Binding System," which claims the benefit of U.S. Provisional Application No. 60/579,526, filed Jun. 15, 2004, and entitled, "EZ multi-function release binding for boards and skis;" and U.S. patent application Ser. No. 10/467,941, filed Aug. 14, 2003 now U.S. Pat. No. 7,178,821, and entitled, "Universal Ski and Snowboard Binding," which claims priority to PCT Application No. PCT/US02/05174, filed Feb. 15, 2002, and entitled, "Universal Ski and Snowboard Binding," which claims priority to U.S. Provisional Patent Application Nos. 60/268,542, filed Feb. 15, 2001, and entitled, "Z Release System;" 60/268,541, filed Feb. 15, 2001, and entitled, "Breakaway Interface;" and 60/348,274, filed Jan. 15, 2002, and entitled, "Z Combo Release & Conversion System," each of which are incorporated by reference in their entirety herein.

FIELD OF THE INVENTION

The present invention relates to bindings configured to secure the foot or feet of a user or rider to a sliding board enabling the user to participate in a sliding sport, such as skiing, snowboarding, wakeboarding, etc. More particularly, the present invention relates to an adjustable tension release binding that is interchangeable, wherein it and or its design may be adapted for use on a plurality of different types of sliding boards, such as water or snow skis, snowboards, water skis, wakeboards and the like.

BACKGROUND OF THE INVENTION AND RELATED ART

Snowboarding, skiing, wakeboarding, and similar sliding sports are increasing in popularity as competitive sports and as recreational activities that are being participated in by numerous people. The sliding boards used in these sports or activities, such as snowboards, skis, wakeboards, and other sliding boards, are continually developing, with new technology improving their functionality and performance.

In recent years, snowboarding has gained in popularity and is nearly as popular as skiing. Unfortunately, the safety aspects of snowboarding equipment lag behind that developed for skiing, particularly with respect to the binding systems provided to secure the snowboard to the feet of the rider. The form of snowboard binding which is currently most broadly used includes two bindings fastened to the snowboard, each binding having a plurality of straps adapted to fasten around a respective boot of the rider. In use, the rider places his or her boot clad feet on the bindings and tightens the straps around the boots to secure the board to the rider's legs. In order to remove the board, the rider must manually and individually unfasten each of the straps to release the snowboard bindings from the rider's boots. Other types of fasteners and bindings are also available, which include plate bindings and step-in bindings.

One significant drawback to these types of bindings is that they are not releasable, meaning that they provide no release function that permits a user's foot to release from the snowboard in response to an undesirable and potentially unsafe load. It is known that the majority of snowboarding injuries are caused or exacerbated by the snowboard remaining secured to the user during a fall. In some extreme cases, fatalities have resulted from suffocation in deep snow with the user unable to release from the snowboard and snowboard binding. With the snowboard unreleased and still attached to the rider's feet, the length of the snowboard can act as an anchor in the event of a snow slide or avalanche, and once covered in snow the rider may not be able to reach the binding straps in order to remove the board. It may therefore be desirable for a snowboard binding to enable the rider's feet and legs to be released from attachment to the board in the event the snowboard is subjected to abnormal forces, such as may occur in the case of a severe fall or an avalanche.

Another difficulty associated with snowboard bindings occurs where the rider wishes to use a ski lift or tow to return to the top of a mountain slope. In order to negotiate lift lines and mount a lift chair, the rider must generally free one foot from the board to facilitate maneuvering into position. Once exiting the lift chair, the free boot must then be re-fastened within the free binding on the snowboard. This constant cycle of unfastening and re-fastening the conventional binding is both physically exhausting and time consuming, and it would therefore be desirable for an improved snowboard binding to enable easier securing and releasing of at least one boot from the board when desired.

Ski bindings are traditionally designed to release the ski from the ski boot if abnormal forces are present between the ski boot and ski binding, so that those forces are not transmitted to the skier's leg where they may cause injury. However, in order to provide adequate and safe release, or tension release, complex mechanisms are employed within the ski bindings. These complex mechanisms typically provide only a limited number of release angles, thus increasing the potential that an impact or other force will not trigger a justified release. Despite their deficiencies, it would be advantageous for snowboard bindings to have a similar tension release mechanism, such that the likelihood of injury is decreased in the event of a severe fall, particularly one in which the body or legs of the snowboarder twist relative to the board.

Another problem with prior related bindings is that there is no interchangeability between the types of sliding boards, thus increasing the expense of participating in more than one sliding sport. Indeed, individuals often like to snowboard, wakeboard, etc. as well as to ski. For example, an individual may want to ski in the morning using alpine skis but later ski in the afternoon on a snowboard. In order to do so, the individual would have to change the type of boots being worn in order to use the alpine skis or the snowboard. Accordingly, it would be a benefit to provide a universal binding that would be as efficient and applicable for alpine skis as it is for snowboards. Further, this universal binding should also be adaptable to other sliding boards, including, but not limited to water skis, wakeboards, and others.

SUMMARY OF THE INVENTION

In light of the problems and deficiencies inherent in prior related bindings, the present invention seeks to overcome these by providing a multi-function binding system having several functional aspects. Indeed, riders of sliding boards, such as snowboards, wakeboards and skis, desire some binding means configured to secure or otherwise releasably affix their feet to the sliding board. In addition, it is desirable to have other features, such as variable and user-adjustable tension release allowing release of the binding system to free the user from the sliding board, infinite release angles, variable and user-adjustable stance orientations, and, optionally, the ability to use a single binding or a single binding design on many different types of sliding boards. Each of these may be provided for in the present invention binding system.

More particularly, and in accordance with the invention as embodied and broadly described herein, the present invention features a binding system configured for use on a sliding board comprising: (a) a binding operable with a boot assembly, the binding comprising a support surface and toe and heel pieces extending therefrom; (b) a base assembly configured to be rotatably and removably secured to a deck of a sliding board and to releasably couple the binding during use of the sliding board, the base assembly comprising: (i) a support disc configured to be removably coupled to the deck of the sliding board and to secure the base assembly to the sliding board; (ii) a deck plate rotatable about the support disc and configured to be positioned adjacent the deck; (iii) a bonnet also rotatable about the support disc and configured to receive and engage the binding, the bonnet operable with the deck plate to support one or more components of the base assembly; (iv) adjustment means for facilitating the rotational adjustment of the bonnet and the deck plate about the support disc and with respect to the sliding board, thereby facilitating a plurality of stance orientations of the boot assembly with respect to the sliding board, the adjustment means configured to selectively engage the support disc at any one of a plurality of adjustment positions; (v) coupling means configured to releasably couple the binding to the base assembly, and therefore the boot system to the sliding board, thereby securing a user thereto; and (vi) release means for actuating the coupling means to release the binding from the base assembly, and therefore the boot system from the sliding board.

The present invention also features a binding system for use on a sliding board comprising: (a) a binding operable with a boot assembly, the binding comprising a support surface and toe and heel pieces extending therefrom, the toe and heel pieces each having a receiver formed therein; (b) a base assembly configured to be rotatably and removably secured to a deck of a sliding board and to releasably couple and support the binding during use of the sliding board, the base assembly comprising: (i) a support disc configured to be removably coupled to the deck of the sliding board and to secure the base assembly to the sliding board; (ii) a deck plate rotatable about the support disc and configured to be positioned adjacent the deck; (iii) a bonnet also rotatable about the support disc and configured to receive and engage the binding, the bonnet operable with the deck plate to support one or more components of the base assembly; (iv) adjustment means for facilitating the rotational adjustment of the bonnet and the deck plate about the support disc, thereby facilitating a plurality of stance orientations of the boot assembly with respect to the sliding board, the adjustment means configured to selectively engage the support disc at any one of a plurality of adjustment positions; (v) release means for facilitating the selective manual release of the binding from the base assembly, and therefore the boot assembly from the sliding board; (vi) a toe plunger supported about a front portion of the bonnet and operable with the release means, the toe plunger being configured to releasably engage the receiver formed in the toe piece of the binding to secure the binding to the base assembly; and (vii) a heel plunger supported about a rear portion of the bonnet and operable with the release means, the heel plunger being configured to releasably engage the receiver formed in the heel piece of the binding.

The present invention further features a binding system for use on a sliding board comprising: (a) a binding operable with a boot assembly, the binding comprising a support surface and toe and heel pieces extending therefrom, the toe and heel pieces each having a receiver formed therein; (b) a base assembly configured to be rotatably and removably secured to a deck of a sliding board and to releasably couple and support the binding during use of the sliding board, the base assembly comprising: (i) a support disc configured to be removably coupled to the deck of the sliding board and to secure the base assembly to the sliding board; (ii) a deck plate rotatable about the support disc and configured to be positioned adjacent the deck; (iii) a bonnet also rotatable about the support disc and configured to receive and engage the binding, the bonnet operable with the deck plate to support one or more components of the base assembly; (iv) adjustment means for facilitating the rotational adjustment of the bonnet and the deck plate about the support disc, thereby facilitating a plurality of stance orientations of the boot assembly with respect to the sliding board, the adjustment means configured to selectively engage the support disc at any one of a plurality of adjustment positions; (v) release means for facilitating the selective manual release of the binding from the base assembly, and therefore the boot assembly from the sliding board; (vi) a toe plunger supported about a front portion of the bonnet and operable with the release means, the toe plunger being configured to releasably engage the receiver formed in the toe piece of the binding to secure the binding to the base assembly, the toe plunger comprising a plurality of pressure surfaces formed therein and configured to receive forces thereon as applied by the binding and to facilitate an optimal selective pre-set tension release of the binding from the base assembly, and therefore the boot assembly from the sliding board, at least one of an infinite number of release angles; and (vii) a heel plunger supported about a rear portion of the bonnet and operable with the release means, the heel plunger being configured to releasably engage the receiver formed in the heel piece of the binding, the heel plunger comprising a plurality of pressure surfaces formed therein and configured to receive forces thereon as applied by the binding and to facilitate an optimal selective pre-set tension release of the binding from the base assembly, and therefore the boot assembly from the sliding board, at least one of an infinite number of release angles, the toe and heel plungers being configured to secure the binding to the base assembly, and therefore the boot assembly to the sliding board.

In one exemplary embodiment, the binding system comprises a base assembly rotatably secured to the deck of a sliding board, with a binding system operable with the base assembly to secure a user to the sliding board. The base assembly comprises various components, namely an adjustment mechanism and a release mechanism, supported within a bonnet that is rotatable about a support disc designed to be secured to the sliding board via the mounting configuration of the sliding board. The support disc couples to the deck of a sliding board preferably using one of various standard hole patterns, such as a three or four-hole or seven-hole pattern, wherein the hole patterns are provided for in the support disc. The support disc functions to rotatably secure the base assembly to the sliding board.

Each of the rider's feet are held in place by a boot system operable with the binding. Each binding is configured to engage the base assembly by fitting the binding over the bonnet and causing the toe and heel plungers to engage the binding, thus securing it in place. In other words, the binding system allows the rider to "step-in" to the binding system simply by placing a foot into the boot assembly, positioning the binding over the base assembly, and applying a downward force to snap the binding in place down onto the base assembly, with the toe and heel plungers engaging and releasably coupling the binding. The base assembly further functions to provide a riser function to improve the performance of the sliding board.

Unlike prior related snowboard binding systems, the present invention binding system is designed to release upon impact or in the event of a fall upon a threshold load or tension setting being exceeded within the binding system. This function is made possible by an adjustable tension release system that may be pre-set by the rider to meet desired specifications. The tension in the binding system is pre-set on at least one, and preferably both, of the toe and heel plungers using a separate spring and shaft system for each toe and heel plunger. The current release tension setting may be viewed through a window formed in the bonnet of the base assembly, which window is shaped and designed to cover the inner functioning mechanisms of the base assembly and to protect these from snow and ice, while still allowing the toe and heel plungers to extend outside the bonnet.

When the toe or heel plunger is subjected to forces or pressures exceeding the tension setting indicated by the rider, the binding system will release, thus allowing the binding to release from the base assembly, and, more importantly, the foot of the rider to release from the sliding board. This is accomplished by the toe and/or heel plungers pressing against a series of release levers, cams, and the spring and shaft assembly behind each toe or heel plunger. In other words, the release mechanism, or release means, is comprised of these several components that actuate with the shaft and spring assembly operable with each toe and heel plunger.

In addition, the toe and heel plungers comprise a specific design to facilitate an infinite number of release angles. This is accomplished by forming at least one, and preferably a plurality, of pressure surfaces in the toe and heel plungers. The pressure surfaces are formed on pressure angles, preferably between 35° and 40°. Providing infinite release angles allows the binding to release from the base assembly at any angle from the horizontal line upward.

The release means may further comprise a quick-release design. In one exemplary embodiment, the release means may comprise a release lever located or positioned about the side of the bonnet. The lever may comprise a handle or knob, wherein the user may grasp the handle and actuate the lever to actuate a cam assembly that acts to displace a toe lever against the toe plunger, causing the toe plunger to retract into the bonnet, in order to allow the user to disengage the binding.

The adjustment means may also comprise a quick-release design, wherein the adjustment means comprises a lever located or positioned on a side of the bonnet opposite from the quick-release release lever. The lever may be configured to releasably engage all or a portion of the support disc, thereby facilitating a plurality of different stance orientations about the sliding board as desired by the rider without requiring the unscrewing of any screws or other similar fasteners.

The present invention still further features a method for securing a rider to a sliding board.

The present invention further features a universal binding apparatus for detachably securing a footwear-type article to a second article, the apparatus comprising: (a) a first plate that can attach to either of the footwear-type and second articles, and that comprises: (i) a toe retaining latch, disposed at a front portion of the first plate, the toe retaining latch comprising a plurality of pressure surfaces formed therein to enable an optimal selective pre-set tension release at an infinite number of release angles; (ii) a heel retaining latch, disposed at a rear portion of the first plate, the heel retaining latch comprising a plurality of pressure surfaces formed therein to enable an optimal selective pre-set tension release at an infinite number of release angles; and (iii) a first release, disposed between the toe retaining latch and the heel retaining latch, to disengage at least one of the toe retaining latch or the heel retaining latch; (b) a second plate that can attach to the article not secured to the first plate and that comprises: (i) a toe clip, disposed at a front portion of the second plate; and (ii) a heel clip, disposed at a rear portion of the second plate, wherein the second plate is detachably secured to the first plate with the toe clip engaged within the toe retaining latch and the heel clip engaged within the heel retaining latch and wherein the first release operates to movably disengage at least one of the toe retaining latch or the heel retaining latch from the second plate.

BRIEF DESCRIPTION OF THE DRAWINGS

The present invention will become more fully apparent from the following description and appended claims, taken in conjunction with the accompanying drawings. Understanding that these drawings merely depict exemplary embodiments of the present invention they are, therefore, not to be considered limiting of its scope. It will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings in which:

FIG. 9-A illustrates a perspective view of a heel plunger according to one exemplary embodiment of the present invention, wherein the heel plunger comprises a plurality of pressure surfaces, each with corresponding pressure angles, and is configured for use with the exemplary base assembly of FIG. 2;

FIG. 9-B illustrates a side view of the heel plunger of FIG. 9-A, wherein a longitudinal pressure surface and its corresponding pressure angle is depicted;

FIG. 9-C illustrates a top view of the heel plunger of FIG. 9-A, wherein opposing pressure surfaces and their corresponding pressure angles are depicted;

DETAILED DESCRIPTION OF EXEMPLARY EMBODIMENTS

Figure 1:
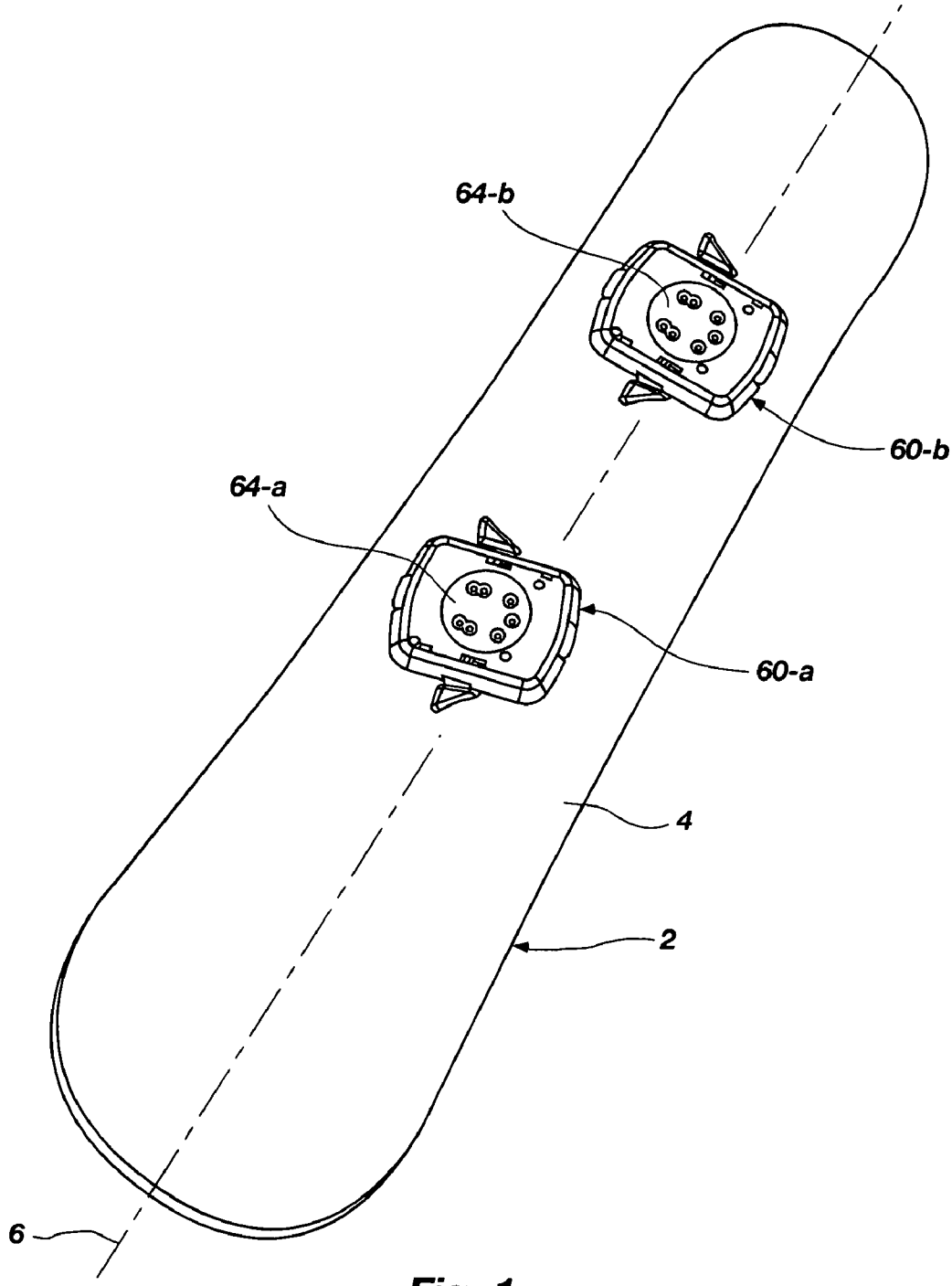
FIG. 1 illustrates a perspective view of a snowboard having two base assemblies attached or coupled thereto according to one exemplary embodiment of the present invention, wherein the base assemblies are adjusted to comprise different stance orientations with respect to the snowboard.

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention, as represented in FIGS. 1 through 14, is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

The following detailed description and exemplary embodiments of the invention will be best understood by reference to the accompanying drawings, wherein the elements and features of the invention are designated by numerals throughout.

For purposes of clarification, the phrase "sliding board," as referred to herein, shall be understood to mean any type of board or board-like device, as commonly known, for use in a sliding sport, wherein the board or board-like device utilizes a binding assembly or binding system to secure the board to the feet or foot of a user. Examples of sliding boards include, but are not limited to snow and water skis, snowboards, wakeboards, and others as known in the art.

The phrase "sliding sport," as referred to herein, shall be understood to mean any type of sport or recreational activity in which a sliding board is required or recommended for participation. Examples of sliding sports include, but are not limited to, water and snow skiing, snowboarding, wakeboarding, and others as known in the art.

The phrase "pressure surface," as referred to herein, shall be understood to mean one or more surfaces formed on one or more of the components of the binding system that are specifically designed to receive and bear a force or load thereon as applied by the binding for the purpose of supporting the binding about the base assembly and securing thereto, and for facilitating the triggering of a tension release of the binding from the base assembly in the event the tension setting is exceeded.

The phrase "pressure angle," as referred to herein, shall be understood to mean the angle at which a pressure surface is configured.

The phrase "release angle," as used herein, shall be understood to mean the angle at which the binding releases from the base assembly upon a tension release.

The phrase "tension release," as referred to herein, shall be understood to mean the triggered release of the binding from the base assembly in response to a load on the pressure angle exceeding the pre-set or pre-determined tension setting, wherein the load may be induced from an impact or excessively applied tension.

The phrase "tension setting" or "pre-set tension setting," as referred to herein, shall be understood to mean the pre-set adjustment in the binding system set by the user to define the maximum acceptable forces or loads that may be placed on the pressure surfaces of the load bearing components of the binding system. This may be alternatively defined as the tension threshold.

The present invention describes a method and system for securing a user or rider to a sliding board via a multi-function binding system.

The present invention provides several significant advantages over prior related binding systems, some of which are recited here and throughout the following more detailed description. First, the binding system incorporates a user adjustable tension release capability that allows the binding to release from the base assembly in response to an impact or other excessive force. This is significantly advantageous when the binding system is used on a snowboard as prior related binding systems are deficient in this area. Moreover, the tension release feature improves the safety to the rider by allowing the feet to release if subjected to abnormal loads. Second, the binding system provides a quick-release, wherein the user can easily manually actuate the release system to release the binding from the base assembly. Third, the binding system provides an adjustment means allowing riders, such as snowboarders, skiers, and the like, to easily adjust the stance orientation of each binding, and therefore each foot, with respect to the sliding board, without having to unscrew screws or other fasteners as is required in most prior related binding systems. The adjustment means is preferably actuated by a quick-release mechanism, similar to the quick-release for the release system. Fourth, the binding system utilizes specifically designed coupling means in the form of plungers or latches, described herein as heel and toe plungers or latches, to effectuate tension release at an infinite number of release angles. Each toe and heel plunger comprises pressure surfaces, both lateral and longitudinal, that provide for lateral and vertical release, as well as various combinations of these. The pressure surfaces are formed at specific angles to provide pressure angles configured to optimize the release of the binding from the base assembly. More specifically, these pressure angles function to provide an optimal counter resistance on the binding before it suddenly releases from the base assembly. The pressure angles are specifically configured to be between 35 and 40 degrees. This range of degrees has been established as that enabling the most optimal release. Fifth, the binding system allows the rider to "step-in" to the binding system by securing the binding to his or her foot, positioning the binding over the base assembly, and causing the binding to engage and couple to the base assembly by causing the toe and heel pieces to engage the corresponding receivers in the binding. Sixth, the base assembly provides a riser function allowing the rider to gain leverage and height, thus reducing or eliminating heel and/or toe drag, two problems common with prior related binding systems. Seventh, the base assembly is designed to be interchangeable, meaning it may be applied or used on different types of sliding boards, thus allowing the binding to couple to different types of sliding boards. The binding system utilizes standard hole mounting configurations, such as three-hole and four-hole configurations. The interchangeability feature allows the rider to use a single binding, or at least a single style of binding, on each of the different sliding boards. This may be especially advantageous to those just learning to use one or more sliding boards as it increases the familiarity and any relatedness between boards.

Each of the above-recited advantages, as well as any others presented herein, will be apparent in light of the detailed description set forth below, with reference to the accompanying drawings. These advantages are not meant to be limiting in any way. Indeed, one skilled in the art will appreciate that other advantages may be realized, other than those specifically recited herein, upon practicing the present invention.

With reference to FIG. 1, illustrated is a perspective view of a sliding board utilizing an exemplary embodiment of a binding system of the present invention. Specifically, FIG. 1 illustrates a sliding board 2 in the form of a snowboard. The snowboard comprises an upper surface or deck 4 on which front and rear base assemblies are mounted, shown as front base assembly 60-*a* and rear base assembly 60-*b*. Each of the base assemblies 60-*a* and 60-*b* are configured to receive a binding (not shown), and therefore a respective foot of a user or rider (the term "rider" and "user" are used interchangeably throughout).

As can be seen, each base assembly 60-*a* and 60-*b* is removably mounted to the deck 4 via a center support disc, shown as support discs 64-*a* and 64-*b*, respectively. The center support disc 64 functions to rotatably secure or mount each base assembly 60-*a* and 60-*b* to the deck 4 of the sliding board 2. As shown, each base assembly 60-*a* and 60-*b* may be adjusted to comprise any desired stance orientation as referenced from a longitudinal axis 6 of the sliding board 2. The adjustability of the base assemblies is discussed in more detail below. Nonetheless, it is noted that the support discs 64-*a* and 64-*b*, although removably mounted to the deck 4 of the sliding board 2, are not configured to rotate. Rather these are mounted in a fixed position with the various other components of each base assembly configured to rotate or otherwise adjust about the support disc 64.

Figure 2:
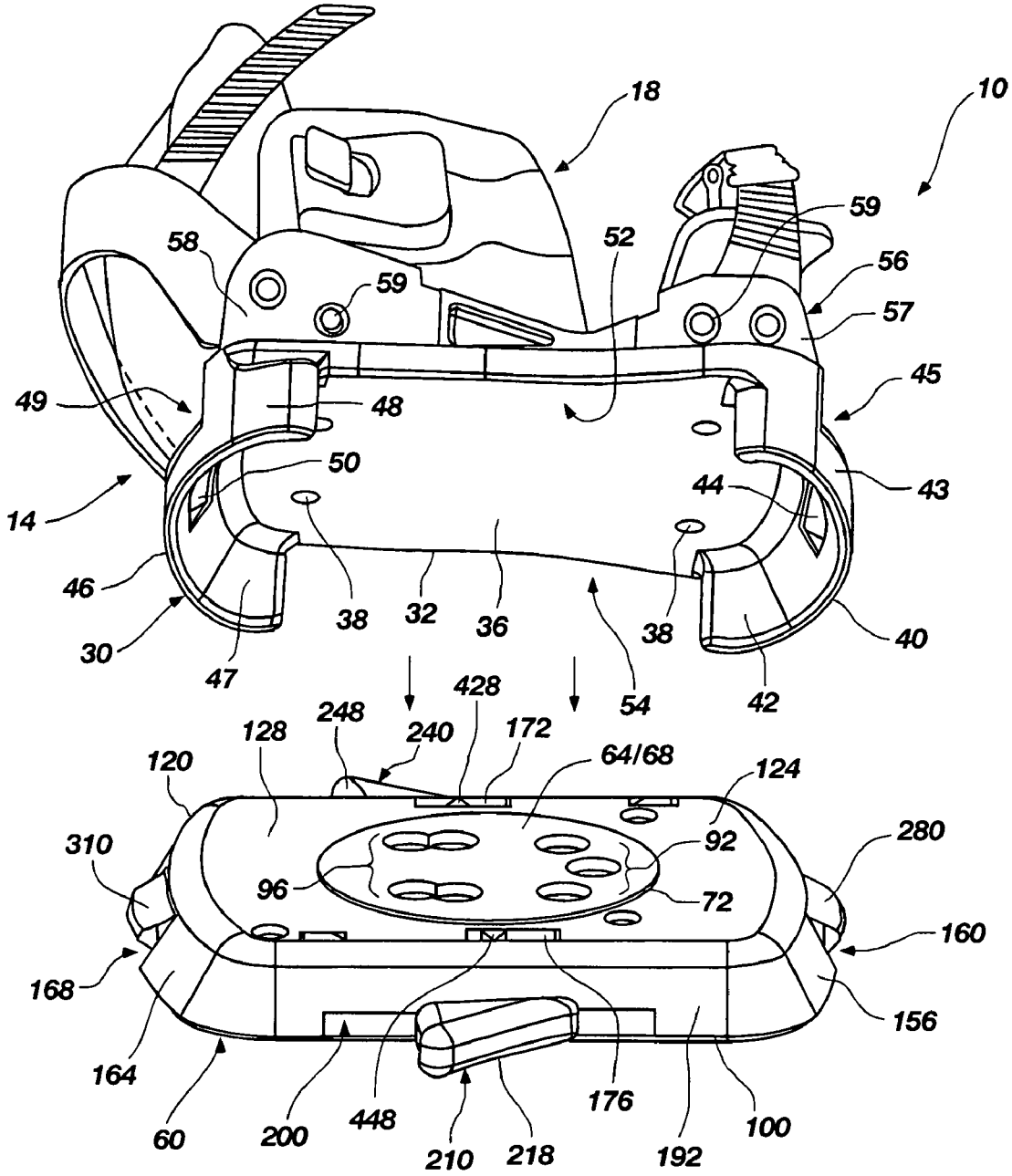
FIG. 2 illustrates a perspective side view of a tension release binding system according to one exemplary embodiment of the present invention, wherein the tension release binding system comprises a binding assembly that releasably couples to a base assembly.

With reference to FIG. 2, illustrated is a side perspective view of the present invention binding system according to one exemplary embodiment, wherein the binding component of the binding assembly is depicted in an elevated position above the base assembly. As shown, the binding system 10 comprises a base assembly 60 configured to be removably mounted to a deck of a sliding board as described above. Once mounted, the base assembly 60 is configured to receive a binding assembly 14 comprising a boot assembly 18 and a binding 30. The boot assembly 18 is configured to receive and secure a foot of a user, and comprises a boot configuration operable with one or more fastening configurations, such as those known in the art. The boot assembly 18 is configured to couple to the binding 30, wherein the binding 30 functions with the boot assembly 18 to support the foot of the user about the base assembly 60 and sliding board (see FIG. 1).

In the exemplary embodiment shown, the binding 30 comprises a primary support plate 32 having an upper surface (not shown) for receiving and supporting a foot of a user, or a foot plate (see foot plate 28 in FIG. 3), and a lower surface 36, which is configured to be positioned adjacent the upper surface 128 of the bonnet 120 and the upper plate 68 of the support disc 64, each of the base assembly 60, when the binding 30 is releasably coupled thereto. As explained below, the lower surface 36 of the primary support plate 32 of the binding 30 may be in contact with and rest against the upper surface 128 of the bonnet 120, or the primary support plate 32 may comprise one or more protrusions 38 designed to be in contact with and rest against the upper surface 128 of the bonnet 120.

The binding 30 also comprises a boot mount 56 configured to receive and secure or support a boot assembly 18. In the exemplary embodiment shown, the boot mount 56 comprises front and rear portions 57 and 58 located on opposing sides of the primary support plate 32 and extending upward therefrom. The front and rear portions each comprise one or more mounting holes 59 configured to receive a fastener therein of any suitable type known in the art and to facilitate the mounting of the boot assembly 18 to the binding 30. The boot mount 56 further functions to provide or assist in the lateral support of a foot of a user as contained in the boot secured to the user's foot. The particular size and geometric configuration of the boot mount 56 is not intended to be limited to that shown in FIG. 2.

The binding 30 further comprises a toe support or toe piece 40 located at a front portion of and extending from the primary support plate 32. The toe piece 40 comprises a geometric configuration that matches that of a front portion or front surface 156 of the bonnet 120 of the base assembly 60. More specifically, the toe piece 40 is configured with an inside surface 42 and an outer surface 43, wherein the inside surface 42 is designed and configured to engage the outer front surface 156 of the bonnet 120, with the front surface 156 of the bonnet 120 providing support to the toe piece 40 and the binding 30. The toe piece 40 further comprises a receiver 44 formed in its inside surface 42. The receiver 44 is sized and configured to receive or engage and releasably secure a toe plunger 280 of the base assembly 60, thus releasably coupling the binding 30 to the base assembly 60. The toe plunger 280 comprises a pre-set tension setting, wherein it provides a counter force acting against the binding 30. Therefore, the receiver 44 comprises a similar geometric configuration as the portion of the toe plunger 280 being inserted therein.

Similarly, the binding 30 further comprises a heel support or heel piece 46 located at a rear portion of and extending from the primary support plate 32. The heel piece 46 comprises a geometric configuration that matches that of a rear portion or rear surface 164 of the bonnet 120 of the base assembly 60. More specifically, the heel piece 46 is configured with an inside surface 47 and an outer surface 48, wherein the inside surface 47 is designed and configured to engage the outer rear surface 164 of the bonnet 120, with the rear surface 164 of the bonnet 120 providing support to the heel piece 46 and the binding 30. The heel piece 46 further comprises a receiver 50 formed in its inside surface 47. The receiver 50 is sized and configured to receive or engage and releasably secure a heel plunger 310 of the base assembly 60, thus releasably coupling the binding 30 to the base assembly 60. The heel plunger 310, like the toe plunger 280, comprises a pre-set tension setting, wherein it provides a counter force acting against the binding 30. Therefore, the receiver 50 comprises a similar geometric configuration as the portion of the heel plunger 310 being inserted therein. Due to their configuration, the toe and heel pieces or supports 40 and 46 function as coupling means to provide both lateral and longitudinal support for the binding 30 about the base assembly 60.

It is noted herein that the terms "toe plunger" and "heel plunger" may be used herein for distinguishing and explanatory purposes only. For example, these two structures may be identical in all respects. The base assembly of the binding system may not comprise designated front and rear portions, but may be oriented so that either end may comprise the front or rear. Stated differently, the front of the binding may be attached to the base assembly with the base assembly facing in either direction.

The binding 30 further comprises front and rear slots 45 and 49, respectively, that are designed to facilitate the attachment of a foot plate to the upper surface of the binding 30 as discussed below and shown in FIG. 3. In addition, the binding 30 comprises lateral slots 52 and 54 located on opposing sides of the binding 30 that permit the binding 30 to couple to the base assembly 30 without interrupting the displacement or actuation of the adjustment and release mechanisms 210 and 240, or any of their component parts, respectively, of the base assembly 60. The lateral slots 52 and 54 are defined by edges of the toe and heel pieces 40 and 46, respectively, as well as an edge of the lower surface 36 of the primary support plate 32.

FIG. 2 also illustrates the base assembly 60 in an assembled state. The base assembly 60 comprises, in part, a support disc 64 that is preferably centrally located within the base assembly 60, although not required. The support disc 64 comprises an upper plate 68 having a perimeter 72, and a lower body portion (not shown, but see lower body portion 76 in FIG. 4). The support disc 64 is designed and configured to be removably fixed to a deck of a sliding board (not shown in FIG. 2, but see deck 4 and sliding board 2 in FIG. 1). As such, the support disc 64 comprises one or more mounting hole configurations. In the exemplary embodiment shown, the support disc 64 comprises both a seven-hole mounting configuration 92 that can also accommodate a four-hole mounting configuration, each of which are standard in the art and each of which may be used depending upon the type of sliding board the binding system 10 is to be used with. One skilled in the art will recognize that the support disc 64 may be secured to the deck of a sliding board using any type of mounting configuration. As such, those shown herein are merely exemplary and not intended to limit the scope of the present invention.

The support disc 64 is further designed and configured to be rotatably supported within the base assembly 60. More accurately, the base assembly 60 is designed to be rotatable about the support disc 64 since the support disc is removably fixed to the deck of the sliding board. The components of the base assembly 60 rotate about the support disc 64 to enable the base assembly 60, and therefore the binding coupled thereto and the rider secured within the binding, to achieve a plurality of different stance orientations with respect to the sliding board.

FIG. 2 illustrates the base assembly 60 as further comprising a bonnet 120 configured to house the various internal components and mechanisms of the base assembly 60. As shown, the bonnet 120 comprises an upper top support plate 124 having an upper surface 128 and a lower surface (not shown). The upper surface 128 is substantially flat and designed and configured to receive and support thereon the substantially flat lower surface 36 of the binding 30 as coupled to the base assembly 60. In essence, the bonnet 120 functions as a riser for the binding 30, thus increasing the height and leverage of the binding system, which helps to reduce or eliminate toe and/or heel drag. Formed in the top support plate 124 of the bonnet 120 is an aperture (not shown in FIG. 2, but see aperture 136 in FIG. 4) sized and configured to receive the support disc 64 therein, as well as to rotatably support the support disc 64, thus facilitating adjustment of the base assembly 60 about the support disc 64 to enable the binding system 10 to achieve different stance orientations with respect to the sliding board. The support disc 64 comprises a lip (not shown, but see lip 84 in FIG. 4) that engages a ledge (also not shown, but see ledge 148 in FIG. 4) to secure the bonnet 120 to the sliding board.

As indicated above, the bonnet 120 further comprises front and rear surfaces 156 and 164 designed to receive and support thereon the matching toe and heel pieces 40 and 46, respectively, of the binding 30. The front surface 156 has formed therein a slot 160 configured to enable the toe plunger 280 to extend outward from the interior of the base assembly 60 past the front surface 156 of the bonnet 120, and to displace bi-directionally back and forth therein. Likewise, the rear surface 164 has formed therein a slot 168 that is configured to enable the heel plunger 310 to extend outward from the interior of the base assembly 60 past the rear surface 164 of the bonnet 120, and to displace bi-directionally back and forth therein.

The bonnet 120 further comprises a first side (not shown, but see first side 188 in FIGS. 4 and 5) and a second side 192, each extending downward from the top support plate 124. As shown, the second side 192 comprises a lateral slot 200 formed therein to allow displacement and actuation of the adjustment mechanism 210, and particularly the locking lever 214 of the adjustment mechanism 210, as intended. The first side also comprises a similar lateral slot (see first side 188 and lateral slot 196 in FIGS. 4 and 5) formed therein that is sized and configured to allow displacement and actuation of the release mechanism 240, and particularly the release lever 244, as intended.

The bonnet 120 further comprises therein a first window 172 configured to provide a view to the dog 428 functioning as an indicator of the pre-set tension setting corresponding to the load placed on the heel plunger 310 by the release mechanism 240. The window 172 comprises an aperture formed in the support plate 124. The bonnet 120 further comprises a second window 176 configured to provide a view to the dog 448 functioning as an indicator of the pre-set tension setting corresponding to the load placed on the toe plunger 280 by the release mechanism 240.

FIG. 2 further illustrates the deck plate 100 located beneath and enclosing the bonnet 120 and the components supported and operable therein. As discussed herein, the deck plate 100 is designed and configured to be adjacent and rest against the deck of a sliding board. The deck plate 100 is formed having one or more pem nuts (see pem nuts 460 in FIG. 4) therein, which may be insert molded into or otherwise secured to the deck plate 100.

Figure 3:
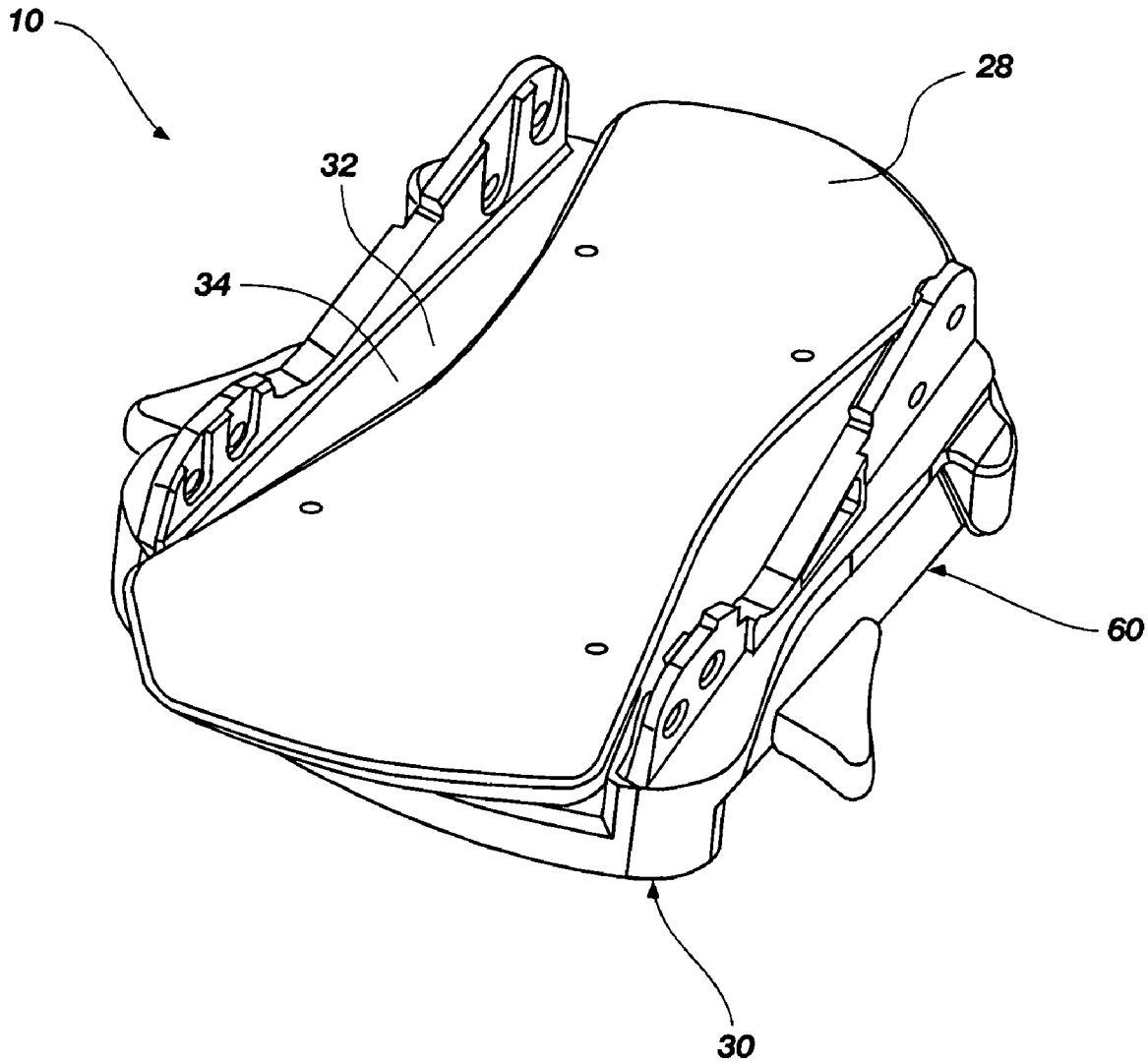
FIG. 3 illustrates a perspective view of a binding coupled to a base assembly, as well as a foot plate operably supported and coupled to a top or mounting surface of the binding.

With reference to FIG. 3, illustrated is a perspective view of the exemplary binding system 10 shown in FIG. 2, wherein the exemplary binding 30 and the exemplary base assembly 60 are shown in a coupled configuration. FIG. 3 further illustrates a foot plate 28 operably supported and coupled to the upper mounting surface 34 of the primary support plate 32 of the binding 30. The foot plate 28 functions to increase the surface area of the binding 30 to better accommodate a foot of a user either with a boot (e.g., in the case of snowboarding) or without a boot (e.g., in the case of wakeboarding). The foot plate 28 may comprise any size and shape, and may comprises one or more contours corresponding to the foot of a user, if appropriate. The foot plate 28 may be optional and selectively removed. Although FIG. 3 illustrates the foot plate 28 as comprising a separate structure, the foot plate 28 may be integrally formed with the binding 30.

With reference to FIGS. 2 and 4-8 illustrated are various views of the exemplary base assembly 60 of the exemplary binding system 10. As can be seen, the base assembly 60 comprises a support disc 64 having an upper plate 68, a perimeter 72 of the upper plate 68, and a lower body portion 76 extending from the upper plate 68, as shown. The lower body portion 76 comprises a sidewall 80 configured to receive one or more components in the adjustment mechanism to selectively position the base assembly 60 in any one of a plurality of available stance orientations with respect to a sliding board. As shown, the sidewall 80 comprises a plurality of teeth 88 formed therein configured to operate with the locking lever 214 to facilitate selective rotation of the bonnet 120, and the components supported therein, about the fixed support disc 64 to achieve and define the plurality of available stance orientations. Furthermore, the upper plate 68 and the lower body portion 76 form a lip 84 at their intersection. The lip 84 is configured to engage a corresponding ledge 148 formed in the bonnet 120, thereby rotatably securing the bonnet 120 and the various components to the sliding board. Thus, the bonnet 120 and the entire base assembly 60 may only be removed from the sliding board upon removal of the support disc 64. The lip 84 and corresponding ledge 148 are further configured to rotate about one another, thus facilitating the rotation of the bonnet 120 with respect to the support disc 64 in the event the stance orientation of the base assembly 60 is desired to be adjusted. The support disc further comprises hole mounting patterns shown as three-hole mounting pattern 92 and four-hole mounting pattern 96.

To mount the base assembly 60 to the sliding board, the bonnet 120, with the deck plate 100 attached, is positioned on the deck of the sliding board in a location about the mounting holes formed in the sliding board. Once the bonnet 120 and deck plate 100 are in position, the support disc 64 is inserted into the apertures 136 and 112 formed in the bonnet 120 and the deck plate 100, respectively, until coming to rest upon the deck of the sliding board, wherein it is then coupled to the sliding board via the mounting holes in the sliding board and those in the support disc 64. The deck plate 100 comprises an upper surface 104 and a lower surface 108, and is configured to function as a support member for many of the components and mechanisms in the base assembly 60, as well as to encase these. The deck plate 100 has several mounting holes 116 formed therein to facilitate the mounting of various base assembly components, such as the adjustment mechanism 210 and the release mechanism 240 (e.g., via pem nuts).

The adjustment mechanism 210 comprises a biased locking lever 214 that is rotatably or pivotally coupled about a pivot point 226, and secured in place by a fastener operable with a pem nut operable with the bonnet 120. The locking lever 214 further comprises a handle or knob 218 designed to provide an ergonomic interface with the user in actuating the adjustment mechanism 210. In the embodiment shown, the adjustment mechanism 210 comprises a series or a rack of teeth 222 formed in the locking lever 214 that are configured to engage the corresponding teeth 88 formed in the support disc 64. A spring 230 functions to bias the locking lever 214, and the rack of teeth 88, towards an engaged position against the support disc 64. The bonnet 120 comprises a sidewall 144 defining the aperture 136. Within the sidewall 144 is a slot 152 configured to provide an opening through which a portion of the locking lever 214 supporting the rack of teeth 222 may pass to engage the support disc 64. The locking lever 214 is shown as being biased by the spring 230, which comprises a high load bearing spring.

With the adjustment mechanism 210 in an engaged position, the deck plate 100, the bonnet 120 and the components contained therein are prohibited from rotating about the support disc 64. To adjust the stance orientation of the base assembly 60 relative to the sliding board, the user simply actuates the adjustment mechanism 210 by grasping the handle 218 and displacing the locking lever 214 to overcome the counter force applied by the spring 230. Upon displacement, the rack of teeth 88 on the locking lever 214 disengage from the teeth 222 on the support disc 64, thereby enabling the bonnet 120 to rotate about the support disc 60. The base assembly 60 may therefore be positioned in any number of adjustment positions resulting in different stance orientations with respect to the sliding board. Indeed, by providing teeth 222 that span entire sidewall 80 of the support disc 64, such as in the embodiment shown, any stance orientation within a 360° rotation may be achieved. The adjustment mechanism 210 is further configured as a quick-release system, wherein a user may vary the stance orientation quickly and easily at any time without having to release the binding.

Other types of adjustment mechanisms are contemplated herein, although these are not specifically described. For example, the lower portion of the support disc may comprise a smooth sidewall. The adjustment mechanism may comprise some type of clamp that clamps to the sidewall in an infinite number of adjustment positions and resulting stance orientations. In still another embodiment, the sidewall may comprise a plurality of apertures formed therein that are configured to receive a corresponding peg or insert formed on the locking lever of the adjustment mechanism to achieve specific adjustment positions and resulting stance orientations.

The release mechanism 240 comprises a release lever 244 having a cam portion 246 formed therein, wherein the release lever 244 is rotatably or pivotally coupled about a pivot point, and also secured in place via a fastener operable with a pem nut supported within the bonnet 120. The release lever 244 further comprises a handle or knob 248 designed to provide an ergonomic interface with the user in manually actuating the release mechanism 240. In the embodiment shown, the release mechanism 240 further comprises a first plunger lever 412 operable with the toe plunger 280 and a second plunger lever 416 operable with the heel plunger 310. Each of the first and second plunger levers 412 and 416 are double acting levers configured to provide compounded motion.

The first and second plunger levers 412 and 416 each comprise along one edge a curved surface that engages and interacts with the linear ledge (see linear ledge 326 in FIGS. 9-A and 9-B) of the respective toe and heel plungers 280 and 310 during actuation of the release mechanism 240. During operation, the first and second plunger levers 412 and 416 exert a force on the toe and heel plungers 280 and 310, as provided by the springs 432 and 452, respectively. In other words, with the release lever 244 retracted and not operable, the springs function to bias the plunger levers, causing them to force the toe and heel plungers outward into an operating position to secure the binding to the base assembly. The toe and heel plungers 280 and 310 are also coupled to the first and second plunger levers 412 and 416, respectively, via respective nubs or posts (see post 312 in FIG. 4) protruding therefrom. The nubs or posts are configured to engage or be located within a corresponding non-concentric aperture formed in the first and second plunger levers 412 and 416 (see aperture 418 in FIG. 4), thus providing a limited degree of slip between the plunger levers 412 and 416 and the toe and heel plungers, respectively.

Figure 7:
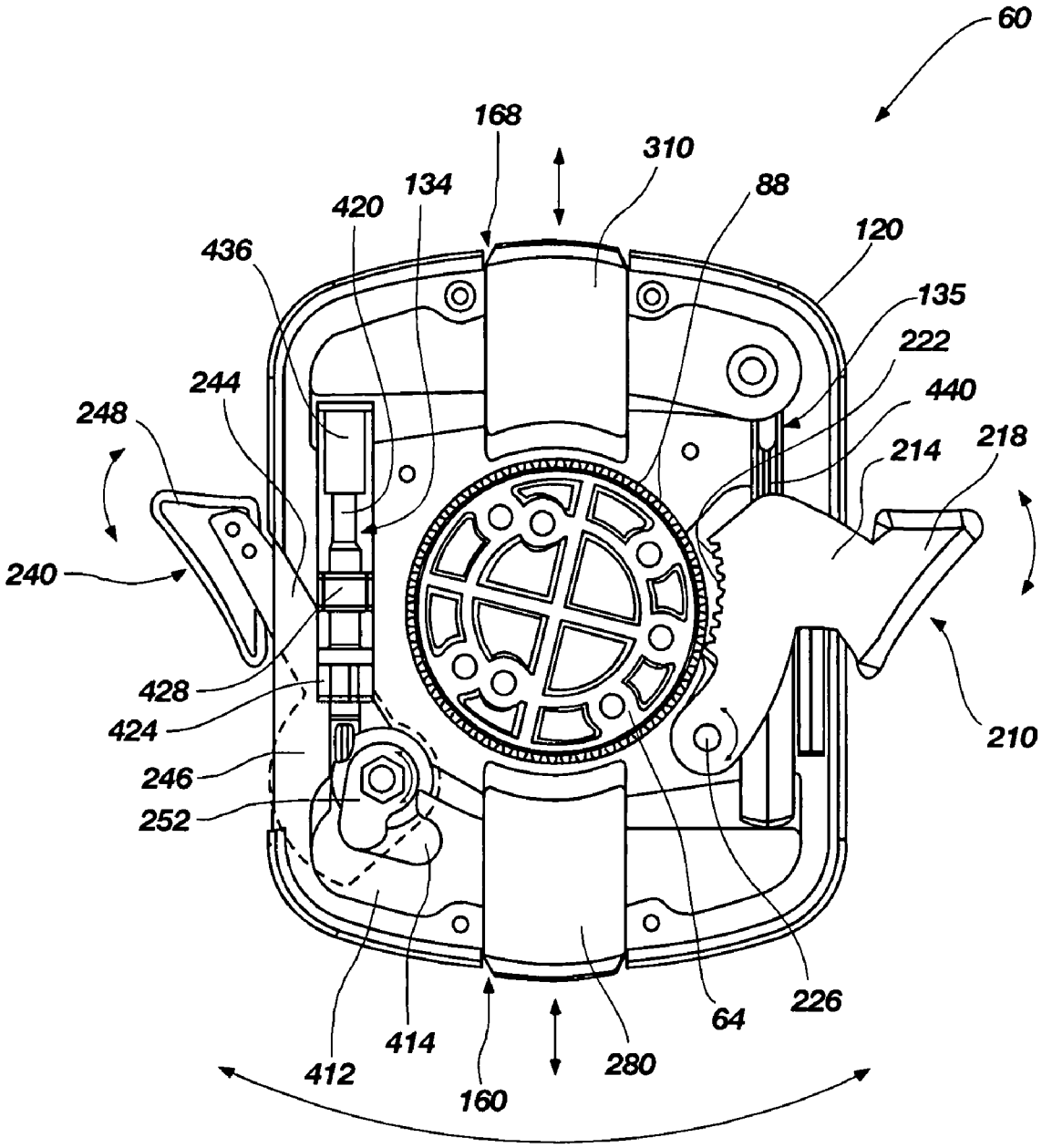
FIG. 7 illustrates a bottom view of the exemplary base assembly of the exemplary tension release binding system of FIG. 2, wherein various release components are depicted that are configured to facilitate both manual and tension release of the binding from the base assembly.
Figure 8:
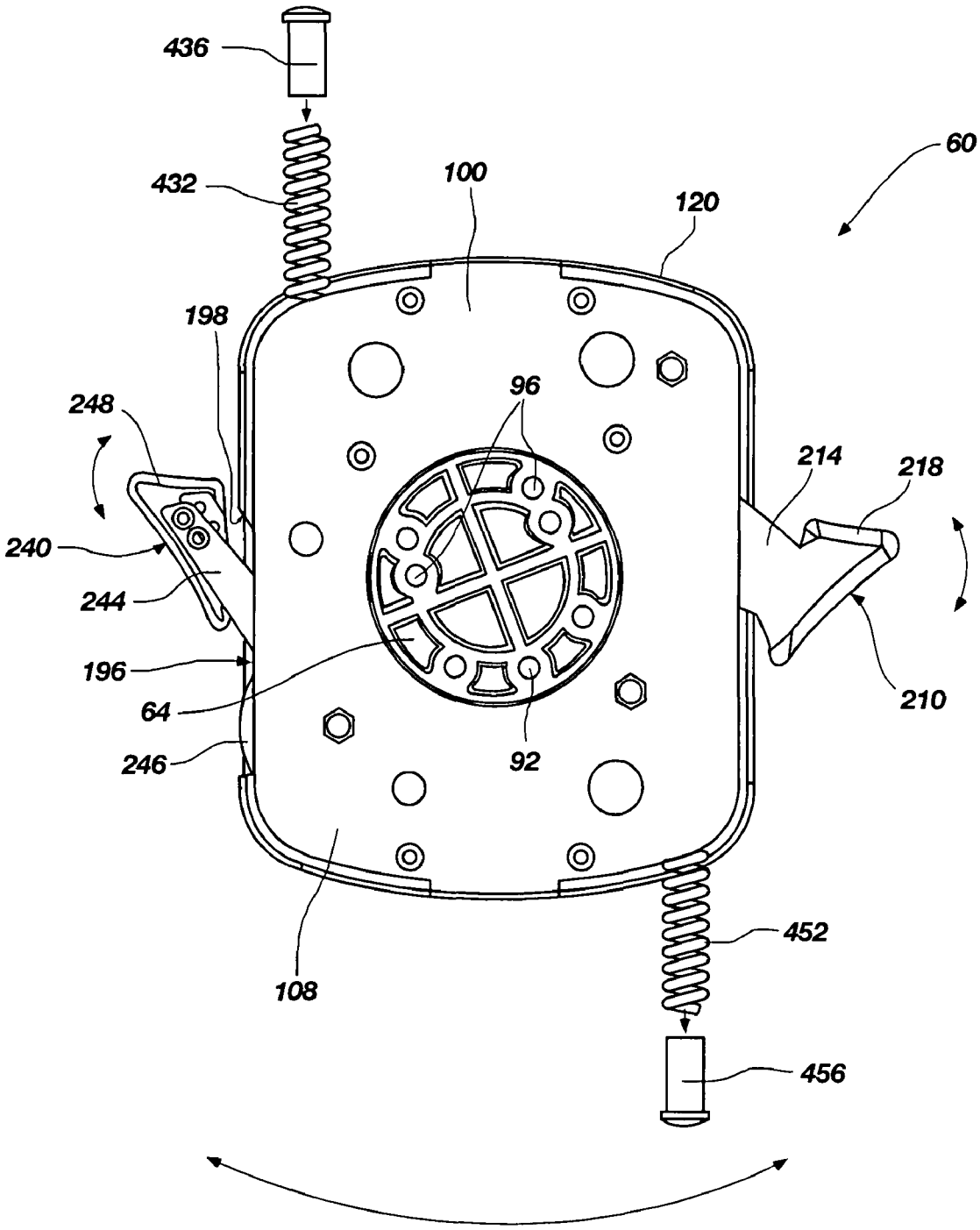
FIG. 8 illustrates a bottom view of the exemplary base assembly of the exemplary tension release binding system of FIG. 2, wherein the deck plate is attached to enclose and support the various components of the base assembly.
Figure 10:
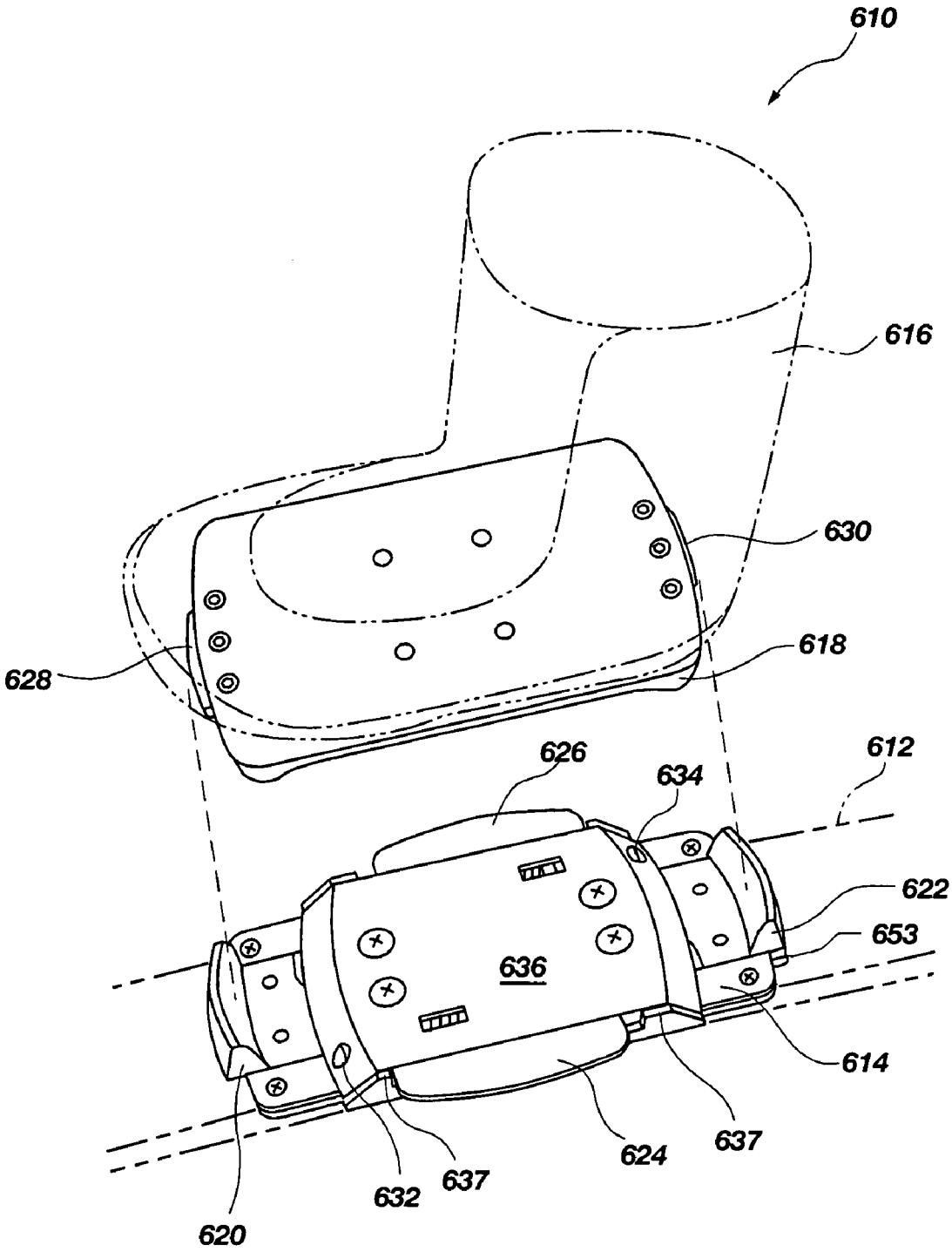
FIG. 10 illustrates a partial exploded perspective view of a universal binding apparatus, according to one exemplary embodiment of the present invention.

Along the opposite edges of the first and second plunger levers 412 and 416 is a surface configuration corresponding to an inside surface configuration of the ends of the bonnet 120, thus allowing the first and second plunger levers 412 and 416 to respectively nest therein when the release mechanism is configured to position the toe and heel plungers in a fully extended position (this configuration is depicted in FIG. 7). The first plunger lever 412 is operably supported at one end by a release cam 252, and is biased by the spring 452 at the other. The first plunger lever 412 preferably comprises a radius along its end that is opposite that operable with the cam 252, which end becomes the fulcrum point of the lever 412 upon manual actuation of the release lever 244, and which radius is commensurate with an inside radius formed along the inside of the bonnet 120. The second plunger lever 416 is pivotally coupled to the bonnet 120 at one end and is biased by the spring 432 at the other, wherein the second plunger lever 416 pivots about pivot point 417.

With the first and second plunger levers 412 and 416 operating to bias the toe and heel plungers 280 and 310 outward, the present invention binding system provides an advantageous release function. Specifically, the release mechanism 240 further provides for tension release, wherein the binding 30 will release from the base assembly 60 upon exceeding a pre-set tension setting set by the user. As part of the exemplary release mechanism shown, a shaft 420 is contained within a slot 134 formed in the bottom surface of the bonnet 120. The shaft 420 supports a shaft journal 424, a dog 428, a spring 432, and a button 436, each configured to operate together to force the plunger lever 416 outward, which in turn forces the heel plunger 310 against the inside surface of the heel support 46 formed in the binding 30. The shaft 420 is threaded and the spring 432 is supported against a shoulder. Any forces acting on the heel plunger 310 to exceed the pre-set tension setting will function to trigger the release mechanism 240 to release the binding 30 from the base assembly 60. More specifically, any forces acting to exceed the pre-set tension setting will cause the plunger lever 416 to force the button 436 adjacent the plunger lever 416 to displace and compress the spring 432, which permits the heel plunger 310 to retract inward towards the bonnet enough to allow the binding 30 to release from the base assembly 60.

As indicated, the release mechanism 240 enables a user to selectively adjust the pre-set tension setting of the binding system. In the exemplary embodiment shown, using the components of the release mechanism operable with the heel plunger 310 as an example, the shaft 420 comprises a gearing system, wherein upon rotation of the shaft 420, the dog 428 is caused to displace about the shaft 420 in a bi-directional manner to vary the compression in the spring 432. As the compression in the spring 432 is varied, this results in a variation of the corresponding tension setting or pre-set tension setting of the release mechanism. In other words, the release tension within the release mechanism may be set to any desirable setting within an available range of tension settings, thus allowing the binding system to accommodate users of different size and riding capabilities. Rotating the shaft 420 to cause the dog 428 to compress the spring 432 causes an increase in the tension setting. Rotating the shaft 420 in an opposite direction reduces the tension. The dog 428 may be caused to be visible through a window formed in the bonnet 120 to visually indicate to a user the current pre-set tension setting.

In accordance with the above-described arrangement, the spring 432 ma be supported about the zin shaft 420 with an amount of preload in order to maintain an outward bias on the heel plunger 310, as well as to limit the number of available pre-set tension settings to a more appropriate range.

Although not specifically discussed, the same tension release feature may be provided on the toe plunger 280. As shown, the tow plunger 280 is operable with a zin shaft 440, a shaft journal 444, a dog 448, and a button 456, each similar to those described above, and each of which function together with the first plunger lever 412 to provide selective pre-set tension settings and tension release of the binding 30 from the base assembly 60 via the toe plunger 280.

The release mechanism 240 further comprises a release cam 252 rotatable about the same pivot point as the release lever 244. The release cam 252 comprises a cam portion 254 contained within a cam track 414 formed in the first plunger lever 412. Upon displacement or actuation of the release lever 244 and subsequent actuation of the release mechanism 240, the release cam 252 is caused to rotate, wherein the cam portion 254 tracks along the cam track 414. This action functions to displace or retract the first plunger lever 412 to effectuate the subsequent refraction of the toe plunger 280, thereby allowing the binding 30 to release from the base assembly 60. Specifically, in order to release the binding 30 from the base assembly 60 at a desired moment, the user simply grasps the handle or knob 248 on the release lever 244 and rotates or pivots the release lever 244 about its pivot point. A certain amount of force is required to be exerted by the user in order to cause the cam portion 254 to track within the cam track 414 of the plunger lever 412. However, as explained below, the amount of needed force is less than what would be required to overcome the tension setting. Causing the cam portion 254 of the release lever 244 to track within the cam track 414 of the plunger lever 412 functions to draw the plunger lever 412 inward. And, as the toe plunger 280 is coupled to the plunger lever 412 (via a similar post and aperture engagement as the post 312 and aperture 418 engagement discussed above) the plunger lever 412 subsequently pulls the toe plunger 280 inward and out of the receiver 44 formed in the binding 30, thus allowing the binding 30 to release from the base assembly 60.

It is noted that in this particular exemplary embodiment, the manual actuation of the release lever 244 and the release mechanism 240 does not require the user to overcome the tension setting and further compress the spring 452 acting on the plunger lever 412 in order to release the binding 30 from the base assembly 60. Rather, the plunger lever 412 is dual acting in that it is configured to pivot within the bonnet 120 due to the radius formed in the lever 412 that is commensurate with the radius in the bonnet 120. The radiused end of the lever 412 is maintained in a substantially nesting relationship with the bonnet 120, thus becoming the fulcrum point of the lever 412, as a result of the spring, button 456 and zin shaft 440 biasing the lever 412. The lever 412 interacts with the button 456 during a manual release function (where the user manually actuates the release lever to retract the toe plunger), as well as about the cam portion 252 during a force-induced release function (where the toe plunger is forced to retract and the tension setting overcome in response to a suitable load acting on the toe plunger).

The toggle action on the first plunger lever 412 allows for the spring 432 to be reduced in strength and spring rate, thus reducing stresses within the release mechanism. As discussed below, the first plunger lever 412 incorporates an additional motion by allowing the cam portion 246 of the release lever 244 to toggle the first plunger lever 412 from it's opposite end upon manually actuating the release lever 244. The second plunger lever 416 is not configured to be additionally manually toggled by the release lever 244.

The base assembly 60 further comprises various spacers, such as rear spacer 400, front spacer 404, and gap spacer 408 to facilitate proper operation of the various mechanisms supported by the base assembly 60.

With reference to FIGS. 9-A-9-C, illustrated are various views of a heel plunger according to one exemplary embodiment of the present invention, wherein the heel plunger comprises a plurality of pressure surfaces, each with corresponding pressure angles, and is configured for use within the exemplary base assembly of FIG. 2. Specifically, as shown, the heel plunger 310 comprises an upper surface 314, a lower surface 318 and a riser 322 extending from the upper surface 314 to form a ledge 326. The riser 322 itself comprises an upper surface 330 and a front surface 334. The riser 322 further comprises several pressure surfaces, shown as first longitudinal pressure surface 338, second longitudinal pressure surface 340, first lateral pressure surface 344 and second lateral pressure surface 348, each with their own corresponding pressure angles.

FIG. 9-B illustrates first and second longitudinal pressure surfaces 338 and 340. The first longitudinal pressure surface 338 comprises a pressure angle $\beta_1$. The second longitudinal pressure surface 340 comprises a pressure angle $\beta_2$. Likewise, FIG. 9-C illustrates first and second lateral pressure surfaces 344 and 348. The first lateral pressure surface 344 comprises a pressure angle $\beta_1$. The second lateral pressure surface 348 comprises a pressure angle $\beta_2$.

The pressure surfaces are specifically configured to comprise pressure angles between 35 and 40 degrees, which is the angle determined to provide optimal tension release of the binding from the base assembly. More specifically, these angles function to provide an optimal counter resistance on the binding before it suddenly releases from the base assembly. In addition, the pressure surfaces are configured to enable the binding to release at an infinite number of release angles since there are no toggle mechanisms present unlike those found in prior related binding systems.

Steeper pressure angles, such as those below 35° (e.g., 30°) are inadequate because they cam out. Thus, steeper angles will not result in adequate release of the binding. More gradual angles, such as those above 40° (e.g., 45°), leaves the binding too loose and does not adequately support the binding and the rider about the base assembly and the sliding board. Providing angles between 35 and 40 degrees allows the optimal pressures to be reached and not exceeded prior to release of the binding. Indeed, the binding must be able to support some pressures and forces to keep the binding and the boot, and therefore the rider, on the sliding board without releasing. However, by supporting too much pressure or force, the binding will not release, thus potentially injuring the rider. Thus a balance must be struck between acceptable pressures for use and those where the binding should release.

In the heel toe 310 shown, the three pressure surfaces and resulting pressure angles function in a similar manner as the three toggles in prior related bindings. However, rather than requiring three separate mechanisms to achieve the three pressure angles, each pressure angle is included in a single mechanism, the heel plunger 310. Thus, the present invention features a single mechanism configured with vertical and lateral pressure angles that facilitate release from the binding in the vertical direction, as well as the two lateral directions.

As can be seen, the surface area on the longitudinal pressure surfaces of the plunger, or those configured for vertical heel tension release, is much greater than the surface area on the lateral pressure surfaces, or those configured to provide lateral heel tension release. This is because the foot can withstand a greater amount of force or pressure in the vertical heel/toe direction than it can in the lateral direction from lateral shear forces. Thus, the forces required for vertical release can be increased to keep the binding from releasing. To accommodate these forces, the longitudinal pressure surface comprises a greater surface area. The opposite is true for the lateral sides of the plunger and the lateral release angles. These do not need to accommodate as great of forces since the foot cannot handle shear forces as well. Thus, the lateral sides of the binding are configured with smaller release angles having smaller surface areas.

Of course, other configurations of the heel plunger are contemplated herein, such as one without a riser. Indeed, the pressure surfaces and the corresponding pressure angles may be incorporated into any number of different plunger configuration. It is specifically noted herein that the heel and toe latches discussed below also comprise both longitudinal and lateral pressure surfaces and corresponding pressure angles.

The present invention further features a universal ski binding apparatus, which is illustrated in FIGS. 10-14. The universal binding apparatus 610 is illustrated for use with a flat or alpine ski 612, which has attached to it a releasable base binding or plate 614 that secures a boot or footwear 616 to ski 612 via a second securing or top plate 618.

The universal ski binding 610 makes both snowboard and ski bindings releasable. It serves as an interface that fits between a snowboard and a snowboard binding or a ski and a ski binding, respectively, to allow them to release the rider from the board at a preset pressure on impact. Further, the rider can perform a quick release via a quick release lever that has been heretofore lacking in the prior art. This enables a reduction in injuries and an increased safety level and performance in both snowboarding and skiing. Further, it provides vertical lift for added carving leverage and lessened toe and hill drag in the snow and fatigue to the rider commonly associated with prior binding systems. The release mechanism is also able to release at all required angles via the novel design interaction of the release surfaces of the mounting plate and the securing top plate. Importantly, the universal snowboard and ski binding provides multiple angles of release, which offers greater safety than the limited angles of release on current ski and snowboard bindings.

Base plate 614 further includes a toe kick latch 620 and a heel kick latch 622 that both slide forward or backward relative to the orientation of ski 612 in order to secure top plate 618 within base plate 614. A first release lever 624 serves to disengage toe kick latch 620 while a second release lever 626 serves to disengage heel kick latch 22. Top plate 618 engages the base plate 614 via a first or toe support 628 and a second or heel support 630, respectively. Both toe kick latch 620 and heel kick latch 622 are spring loaded so that when a sufficient force is applied to top plate 618, such as when a skier falls, the toe kick latch 620 or heel kick latch 622 will travel a sufficient enough distance to release its respective toe support 628 or heel support 630. This releases the top plate and frees the skier from possible bodily injury or property damage. As indicated above, each of the toe and heel latches comprise pressure surfaces and corresponding pressure angles similar to those discussed above, which discussion is incorporated herein. The pressure surfaces are specifically configured to comprise pressure angles between 35 and 40 degrees, thus optimizing the tension release of the top plate.

Additionally, with the platform provided by the binding system 610, snowboarders and skiers can eliminate the need for risers or "gas pedals" normally used to reduce toe and heel drag. For example, in skiing, traditional bindings place the ski boot right on the surface of the ski, which can lead to drag as the skier cuts sharply for a turn. Risers have been used to elevate the ski boot above the top surface of the ski, thereby reducing or eliminating drag. These risers are no longer necessary when the binding apparatus 610 is utilized instead.

The tension for the springs that control the force on toe latch 620 and heel latch 622 is adjustable via an adjusting screw 632 and 634, respectively. Each screw 632 and 634 may be turned with either an Allen wrench or a screwdriver, such as a flat head or a Phillips, so that proper tension desired by the user can be quickly achieved. To protect the spring and latching mechanism, a cover plate 636 is firmly secured atop the base plate 614 and is supported by cover support tabs 637. Cover support tabs 637 are integrated within base plate 614.

Figure 11:
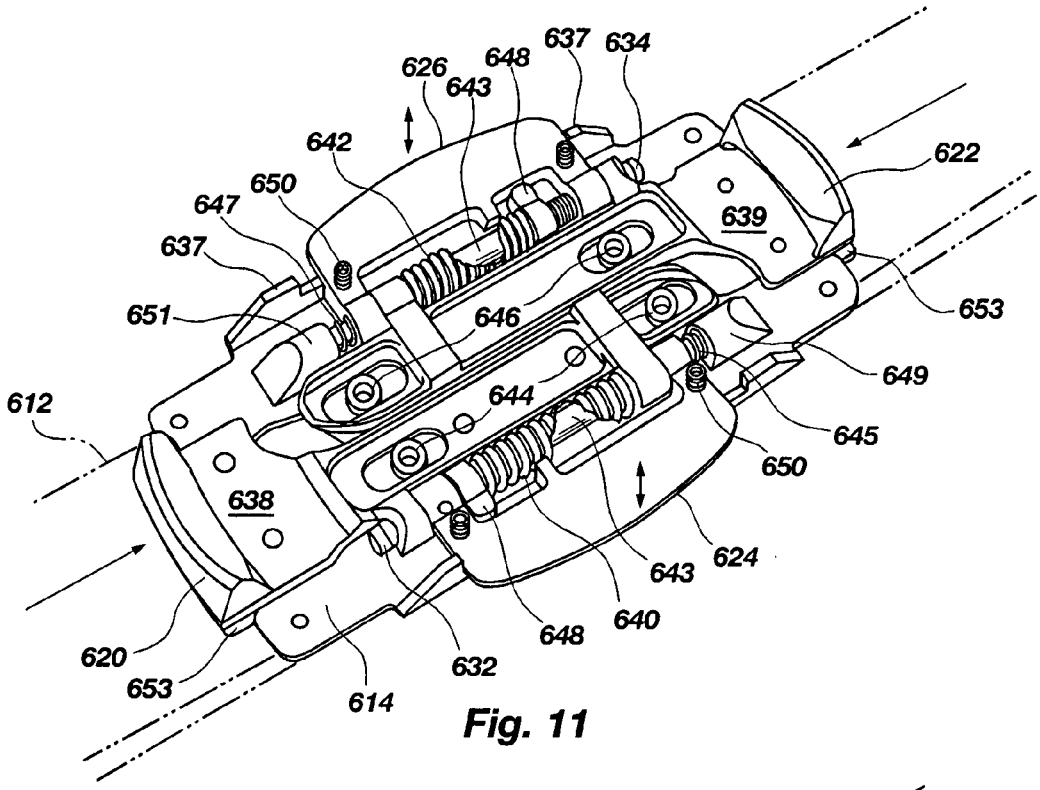
FIG. 11 illustrates a perspective view of the inside mechanism utilized in the universal binding system of FIG. 10, wherein the toe and heel plates are positioned in an open or released position.
Figure 12:
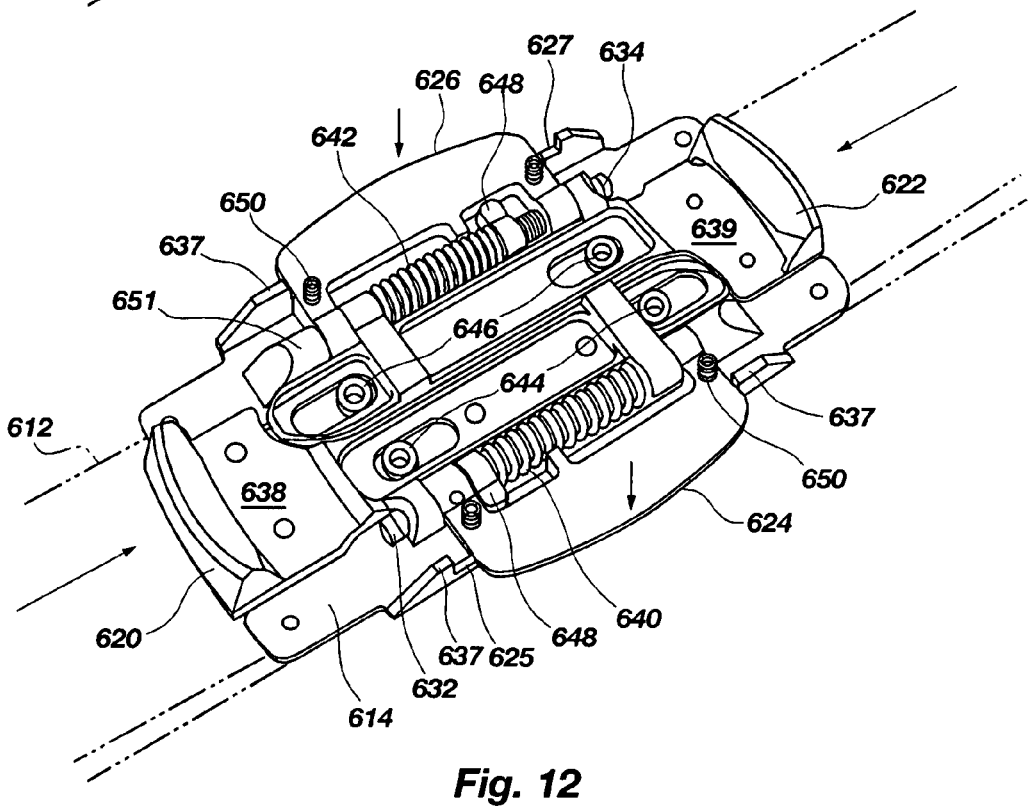
FIG. 12 illustrates a perspective view of the universal binding system of FIG. 11, wherein the toe and heel kick plates are positioned in a secured position.
Figure 13:
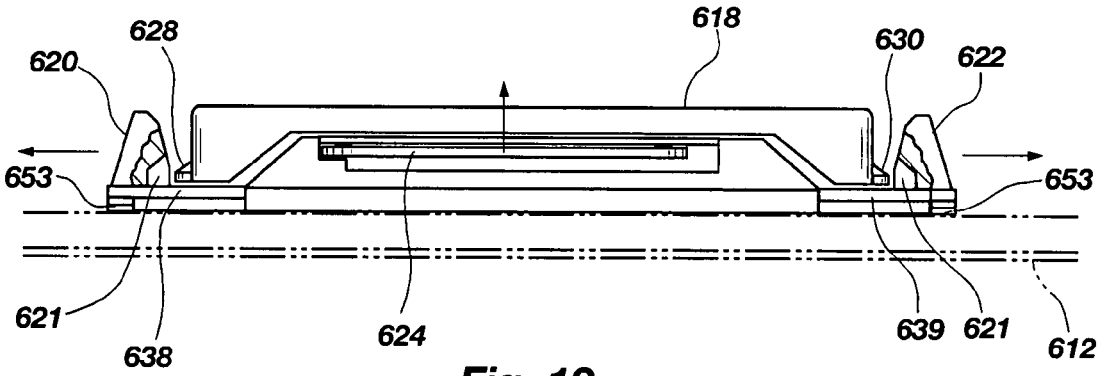
FIG. 13 is a side plan view of the universal binding apparatus according of FIG. 11, wherein the first release is positioned in a full release position.
Figure 14:
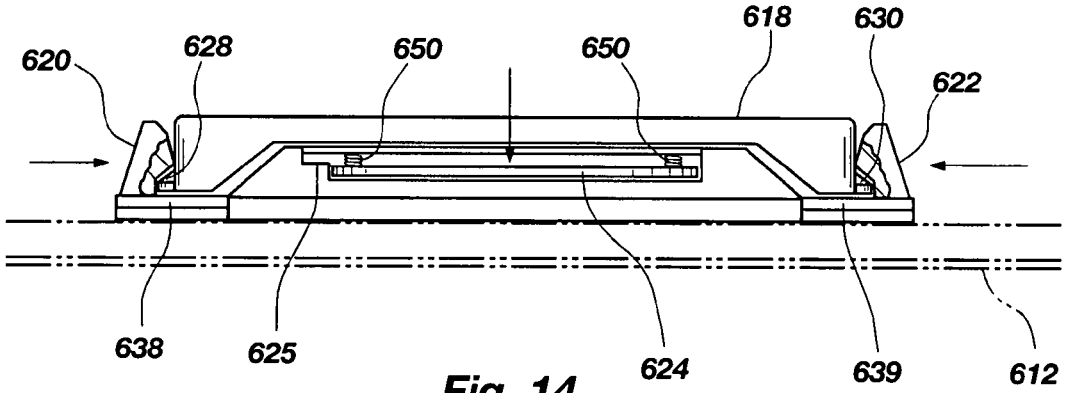
FIG. 14 illustrates a side plan view of the universal binding apparatus of FIG. 13, wherein the first release is positioned in a latched position.

FIGS. 11 and 12 illustrate first a release position (FIG. 11) and then a secure position (FIG. 12). It is noted that the kick latches 620 and 622 move in opposite directions along the same line of engagement in order to secure top plate 618. Each kick latch 620 and 622, as previously stated, is held within a fixed position by release levers 624 and 626, respectively. First release lever 624 causes toe kick latch 620 to release and disengage the top plate 618 when lifted upwardly. Second release lever 626 operates in the same manner for releasing heel kick latch 622. Release levers 624 and 626 allow the rider conveniently to release him self while in deep powder or in any other situation. A lanyard or cord can be attached to either release lever 624 or 626 so that the rider can pull on the cord from a distance in order to release the rider from the board.

Figure 4:
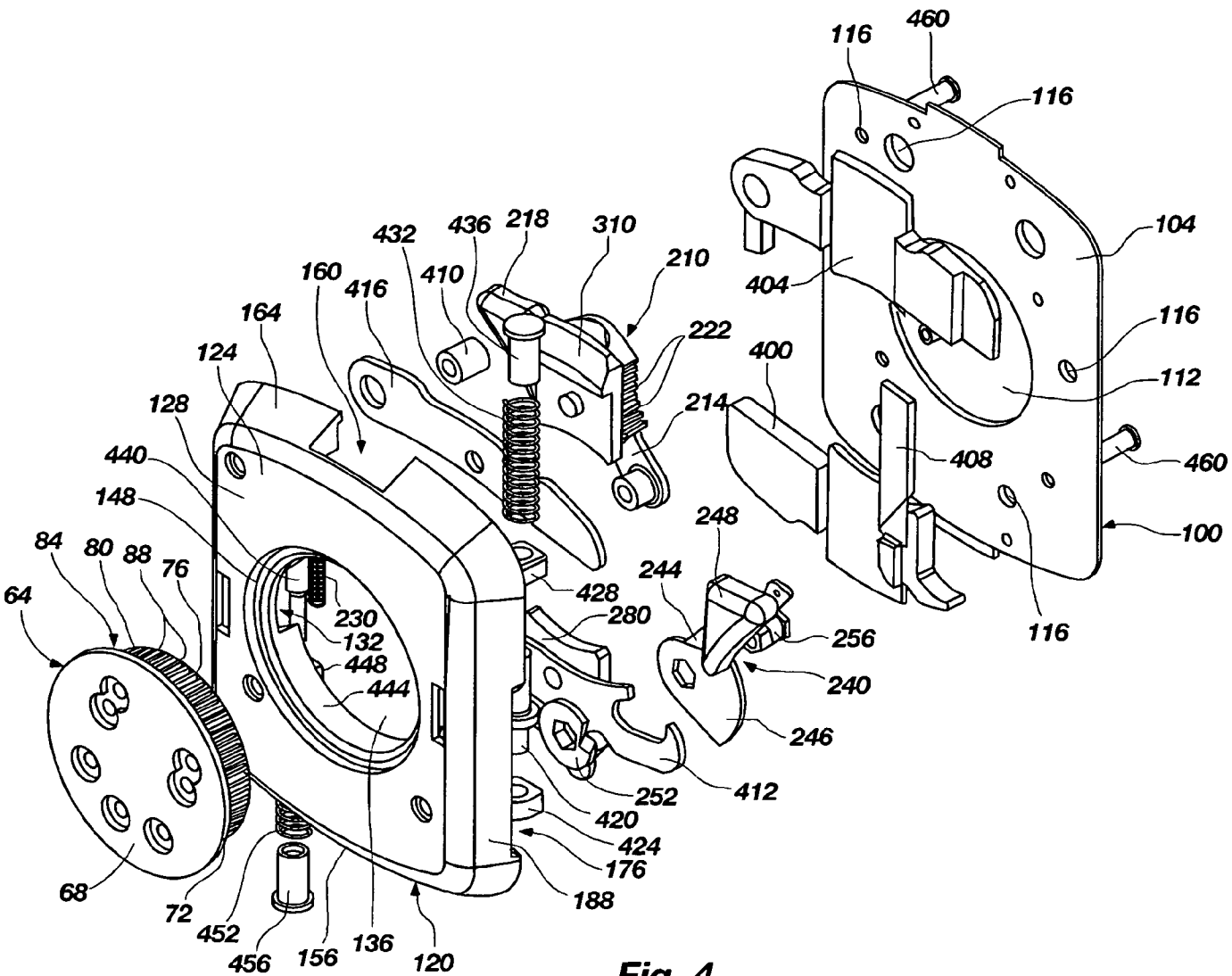
FIG. 4 illustrates an exploded perspective view of the various component parts of the exemplary base assembly of the exemplary tension release binding system of FIG. 2.
Figure 5:
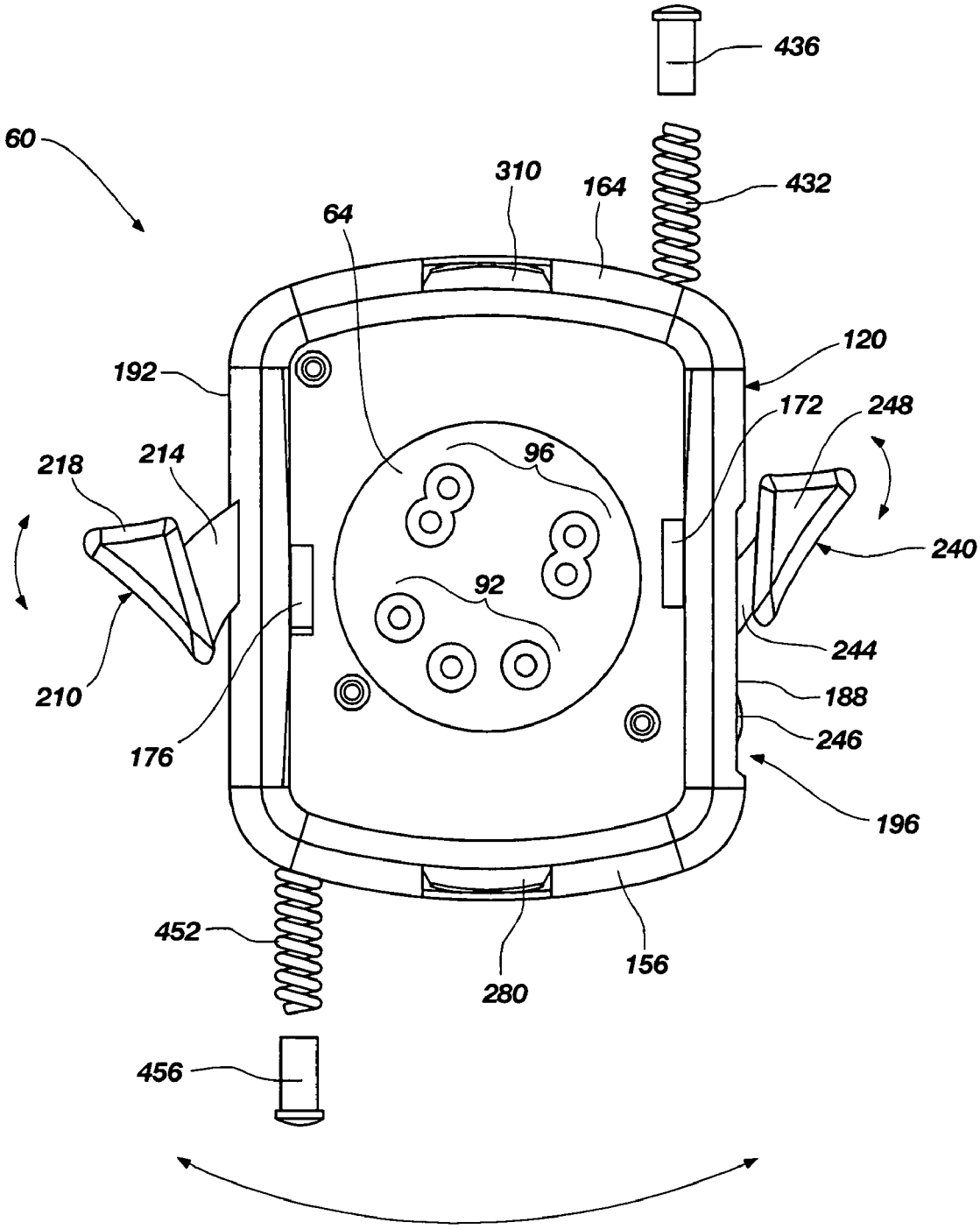
FIG. 5 illustrates a top view of the exemplary base assembly of the exemplary tension release binding system of FIG. 2.
Figure 6:
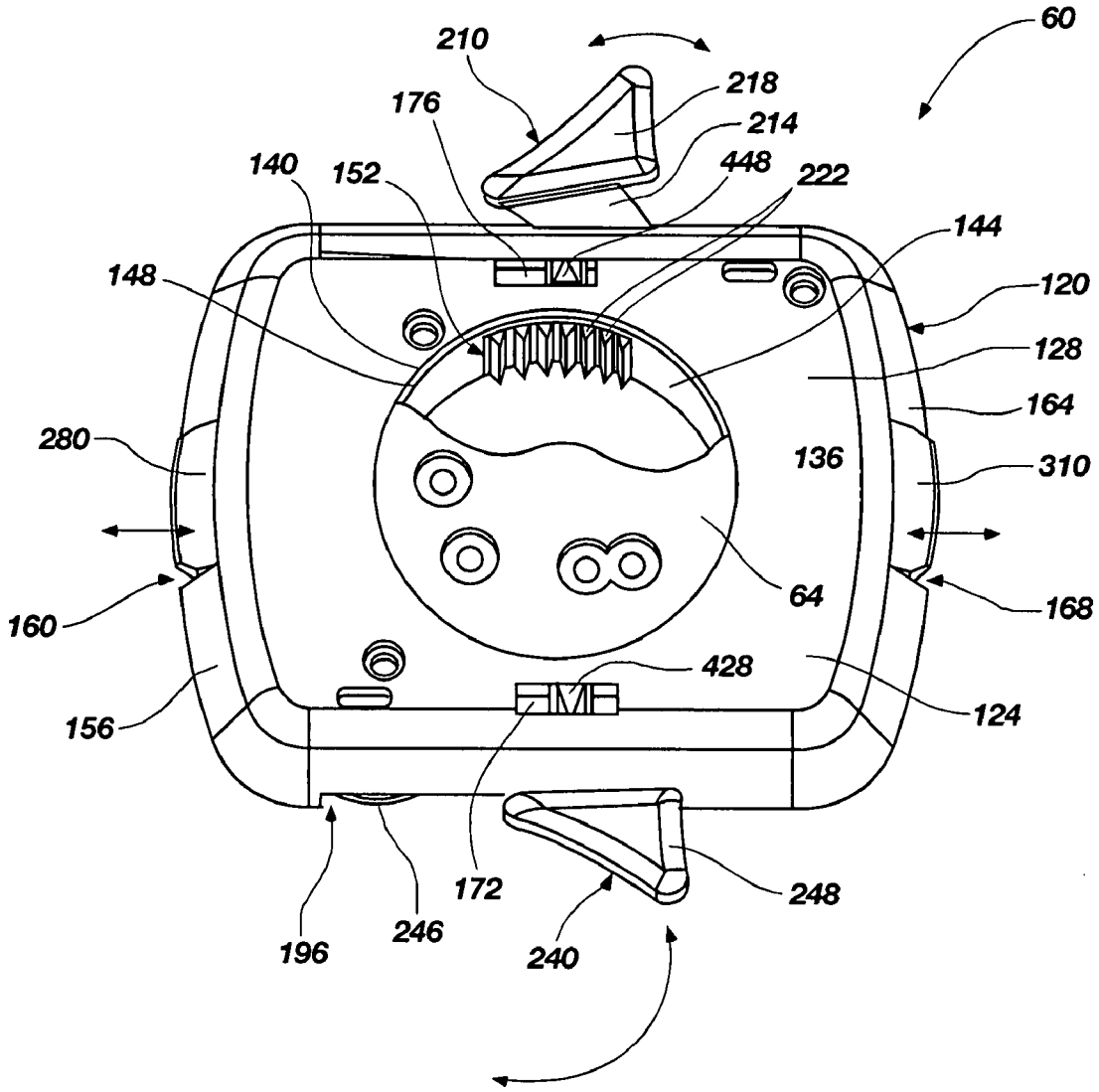
FIG. 6 illustrates perspective view of the exemplary base assembly of the exemplary tension release binding system of FIG. 2, wherein the support disc is partially cut-away to reveal the teeth formed in the locking lever that are configured to engage the corresponding teeth formed in the support disc to provide a plurality of adjustment positions within the binding system to vary the stance orientation with respect to the sliding board.

Once one of the kick plates has been released either in a fall or by one of the release lever 624 or 626, the rider can then reengage the kick latch 620 or 622 by simply kicking them in the retaining position towards the main body of the bottom plate 614. This feature allows the rider to reengage the bindings without needing to bend over or sit down in the snow, which then allows the rider to step back into the binding apparatus without difficulty. Kick latches 620 and 622 slide back so that release levers 624 and 626 are held in place via release notches 625 and 627, respectively, as shown in FIGS. 4 and 5. FIG. 4 illustrates the position of toe kick latch 620 in the released position while FIG. 5 illustrates the kick latches 620 and 622 engaging the top plate 618.

Each kick latch 620 and 622 further includes a recess 621, which is utilized to retain or hold toe support 628 or heel support 630 in place when kick latches 620 and 622 are moved to their latch position.

Toe kick latch 620 is actually part of a kick plate 638 as shown in FIGS. 2 and 3. Kick plate 638 is held in place within base plate 614 via a pair of set screws 644, which allow kick plate 638 to slide between a first and second position. Likewise, heel kick latch 622 is part of a kick plate 639, which can slide freely, but is held in place via set screws 646. Set screws 646 are identical to set screws 644. Each kick plate 638 and 639 is designed to be identical in configuration, which simplifies production, assembly and replacement or repair work.

The base plate 614 further includes several sets of springs, which are used to provide tension and force for holding the latches 620 and 622 in position and enable them to release under desired conditions. A first set of springs includes springs 640 and 642. Springs 640 and 642 serve to bias the kick plates 620 and 622, respectively, opposite one another. The large set of springs 640 and 642 control the release tension as well. The next set of springs 645 and 647 are placed within spring retainers 649 and 651, respectively. Springs 645 and 647 serve to control the lateral pressure on the release levers 624 and 626. The last set of springs 650 ride in shallow cavities etched into the under surface of cover 636. Springs 650 support the base plate cover 636 and urge the release lever 624 and 626 in place, below notches 625 and 627, respectively, once the latches 620 and 622 are moved into their retention orientation.

Each main spring 640 and 642 is held in position by a binding release tension shaft 643, which allows the spring to be compressed for a given tension as well as secures the release lever 624 and 626 in combination with the kick latches 620 and 622, respectively. A cam 648 is also moveably secured on binding release tension shaft 643 and operates with the release plate to adjust the release tension of either kick plate 638 or kick plate 639 when they are engaged with the release levers 624 or 626. As the tension adjustment screw 632 or 634 is turned, the cam 648 is retained within notches formed in part of the release levers 624 and 626 such that the spring force is increased or decreased, depending on how the screws are turned. Binding release tension shaft 643 can have either right handed or left handed threads. Retention tabs 653 are formed under each of kick latch 620 and 622 and which engage plate 614 while engaging the top plate 618. Retention tabs 653 engage notches 672, shown in FIG. 11.

Cover plate 636 has a useful shape that allows it to rest against the top plate surfaces to eliminate problems with release consistency that are typically caused by floating or "relative," tension between the heel and toe releases. Cover plate 636 is prevented from traveling against top plate 618; otherwise, the top plate would float on the cover. Cover plate 636, therefore, serves as a cover retention and release surface. The universal binding system 610 is designed to work well with very narrow skis and the release plates are modified to be utilized with a conventional ski. A rider can then use the same universal binding system on any other board that they may use which allows them to use the same boots with either the skis or the snowboard. The system is also able to work with most soft bindings and boots as a firm exoskeleton, shown in FIG. 610, can be adapted to include a top plate 618 for binding with bottom plate 614.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A binding system configured for use on a sliding board comprising:

a binding operable with a boot assembly that secures a foot of a user;

a base assembly configured to be rotatably and removably secured to a deck of a sliding board and to releasably couple said binding and said boot assembly about said sliding board, said base assembly comprising:

a first component configured to be removably coupled to said deck of said sliding board; and a second component rotatably secured about said first component and said sliding board, said second component comprising an adjustment mechanism operational when said binding and said boot assembly are coupled about said base assembly to achieve a plurality of stance orientations, the adjustment mechanism being disengageable to facilitate the rotational adjustment of said second component about said first component and said sliding board, and reengageable to prohibit the rotational adjustment, and a release mechanism configured to receive and engage said binding, wherein said binding system facilitates both tension release and selective release of said binding from said base assembly, and wherein said tension release is caused by a force acting between said binding and said base assembly that overcomes a preset tension setting.

2. The binding system of claim 1, wherein the release mechanism comprises:

a first plunger supported about a front portion of said second component and operable with said release mechanism, said first plunger being configured to releasably engage a receiver formed in a toe piece of said binding; and a second plunger supported about a rear portion of said second component, said second plunger being configured to releasably engage a receiver formed in a heel piece of said binding.

3. The binding system of claim 2, wherein said first and second plungers are biased and comprise a variable pre-set tension setting.

4. The binding system of claim 2, wherein said first plunger comprises at least one pressure surface formed therein and configured to receive a force thereon as applied by said binding and to facilitate an optimal selective pre-set tension release of said binding from said base assembly at least one of an infinite number of release angles.

5. The binding system of claim 4, wherein said pressure surface is formed at a pressure angle.

6. The binding system of claim 5, wherein said pressure angle is configured to be between 35° and 40°.

7. The binding system of claim 2, wherein said second plunger comprises at least one pressure surface formed therein and configured to receive a force thereon as applied by said binding and to facilitate an optimal pre-set tension release of said binding from said base assembly at least one of an infinite number of release angles.

8. The binding system of claim 7, wherein said pressure surface is formed at a pressure angle.

9. The binding system of claim 8, wherein said pressure angle is configured to be between 35° and 40°.

10. The binding system of claim 1, wherein said first component comprises an coupling arrangement selected from the group consisting of a standard three-hole coupling arrangement and a standard four-hole coupling arrangement.

11. The binding system of claim 1, wherein said base assembly, and therefore said binding system, is interchangeable and configured for use on different types of sliding boards.

12. The binding system of claim 1, wherein said second component comprises a raised mounting surface that supports said binding and that is strategically configured to increase leverage and height for said user, as well as to reduce potential heel and toe drag.

13. The binding system of claim 2, wherein said binding functions to release from said base assembly upon said binding exerting a force and resulting pressure on at least one of said first and second plungers that exceeds a threshold pre-set tension release.

14. A method for operating a sliding board, said method comprising:

obtaining a sliding board;

equipping said sliding board with a universal binding system, said binding system comprising:

a binding operable with a boot assembly;

a base assembly configured to be rotatably and removably secured to a deck of said sliding board and to releasably couple said binding and said boot assembly about said sliding board, said base assembly comprising:

a first component configured to be removably coupled to said deck of said sliding board; and a second component rotatably secured about said first component and said sliding board, said second component comprising an adjustment mechanism operational when said binding and said boot assembly are coupled about said base assembly to achieve a plurality of stance orientations, the adjustment mechanism being disengageable to facilitate the rotational adjustment of said second component about said first component and said sliding board, and reengageable to prohibit the rotational adjustment, and a release mechanism configured to receive and engage said binding, and to facilitate both tension release and selective release of said binding from said base assembly, wherein said tension release is caused by a force acting between said binding and said base assembly that overcomes a preset tension setting;

causing said binding to releasably engage said base assembly via said release mechanism; and operably supporting a user about said sliding board via said binding system to facilitate an intended use of said sliding board about a surface.

15. The method of claim 14, further comprising:

obtaining a second sliding board of a different type;

equipping said second sliding board with said universal binding system; and operably supporting a user about said second sliding board via said binding system to facilitate an intended use of said sliding board about a surface, said binding system being universally interchangeable between different types of sliding boards.

16. A binding system configured for use on a plurality of different types of sliding boards, the binding system comprising:

a binding separable from and operable with a boot assembly; and a base assembly configured to be removably secured to a deck of a sliding board and to releasably couple said binding and said boot assembly about said sliding board, said base assembly comprising a release mechanism, with user adjustable tensioning configured to receive and engage said binding, and to facilitate both tension release and selective release of said binding from said base assembly, wherein said tension release is caused by a force acting between said binding and said base assembly that overcomes a preset tension setting, said base assembly comprising a first component configured to be removably secured to a deck of a sliding board, a second component rotatably secured about said first component and said sliding board, and an adjustment mechanism operational when said binding and said boot assembly are coupled about said base assembly to achieve a plurality of stance orientations, the adjustment mechanism being disengageable to facilitate the rotational adjustment of said second component about said first component and said sliding board, and reengageable to prohibit the rotational adjustment.

17. The binding system of claim 16, wherein the base assembly and the release mechanism further comprises a base plate operable with a toe kick latch and a heel kick latch, each of which are operable with a respective kick plate, and each that both slide forward or backward relative to the orientation of the sliding board in order to secure a top plate of the binding about the base plate.

18. The binding system of claim 17, wherein the release mechanism further comprises a first release lever to disengage the toe kick latch and a second release lever to disengage the heel kick latch, the release levers each being biased and urged into place within respective notches formed in the base plate once the toe kick and heel kick latches are moved into a retention orientation.

19. The binding system of claim 17, wherein said toe and kick latches comprise at least one pressure surface formed therein, each being configured to receive a force thereon as applied by said top plate and to facilitate an optimal selective pre-set tension release of said binding from said base assembly at least one of an infinite number of release angles.

20. The binding system of claim 19, wherein said pressure surface is formed at a pressure angle.

21. The binding system of claim 20, wherein said pressure angle is configured to be between 35° and 40°.

22. The binding system of claim 17, wherein the base plate further comprises biasing means configured to bias the respective kick plates to hold the toe kick and heel kick latches in position, to facilitate their release under desired conditions, and to control the release tension.

23. The binding system of claim 22, further comprising means for adjusting the release tension.

24. The binding system of claim 18, further comprising a release cord attached to at least one release lever actuatable by the rider to release the binding from the base assembly, and therefore the rider from the sliding board.

* * * * *